US011460188B2

(12) United States Patent
Kendrick et al.

(10) Patent No.: US 11,460,188 B2
(45) Date of Patent: Oct. 4, 2022

(54) ULTRA LOW EMISSIONS FIRETUBE BOILER BURNER

(71) Applicant: ClearSign Technologies Corporation, Tulsa, OK (US)

(72) Inventors: Donald Kendrick, Bellevue, WA (US); Douglas W. Karkow, Mount Vernon, IA (US); Venkatesh Iyer, Redmond, WA (US); James K. Dansie, Seattle, WA (US); Jonathan Bucher, Kenmore, WA (US); Aaron Salzbrun, University Place, WA (US)

(73) Assignee: ClearSign Technologies Corporation, Tulsa, OK (US)

( * ) Notice: Subject to any disclaimer, the term of this patent is extended or adjusted under 35 U.S.C. 154(b) by 149 days.

(21) Appl. No.: 16/444,420

(22) Filed: Jun. 18, 2019

(65) Prior Publication Data

US 2019/0368723 A1 Dec. 5, 2019
US 2020/0340664 A9 Oct. 29, 2020

Related U.S. Application Data

(63) Continuation-in-part of application No. 15/215,401, filed on Jul. 20, 2016, now Pat. No. 10,359,213,
(Continued)

(51) Int. Cl.
*F23D 14/14* (2006.01)
*F23C 3/00* (2006.01)
(Continued)

(52) U.S. Cl.
CPC ..... *F23C 3/002* (2013.01); *F23C 6/02* (2013.01); *F23C 99/001* (2013.01); *F23D 14/145* (2013.01)

(58) Field of Classification Search
CPC .... F23D 11/406; F23D 14/14; F23D 2212/10; F23D 2203/104; F23D 2208/00;
(Continued)

(56) References Cited

U.S. PATENT DOCUMENTS 2,095,065 A 10/1937 Hays
2,604,936 A 7/1952 Kaehni et al.
(Continued)

FOREIGN PATENT DOCUMENTS

CN 2484481 4/2002
CN 1950646 4/2007
(Continued)

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.
(Continued)

*Primary Examiner* — Gregory A Wilson
(74) *Attorney, Agent, or Firm* — Launchpad Intellectual Property, Inc.; Christopher A Wiklof; Nicholas S Bromer

(57) ABSTRACT

According to an embodiment, a fired heater includes a fuel and combustion air source configured to output fuel and combustion air into a combustion volume, the combustion volume including a combustion volume wall defining a lateral extent separate from an exterior volume. According to an embodiment, the fired heater includes a boiler heater and the combustion volume wall comprises a combustion pipe defining a lateral extent of the combustion volume, the combustion pipe being disposed to separate the combustion volume from a water and steam volume. The fired heater includes a mixing tube aligned to receive the fuel and combustion air from the fuel and combustion air source. The
(Continued)

mixing tube may be separated from the combustion volume wall by a separation volume. The fired heater includes a bluff body flame holder aligned to receive a fuel and combustion air mixture from an outlet end of the mixing tube. The bluff body flame holder may be configured to hold a combustion reaction for heating a combustion volume wall. The combustion volume wall may include a combustion pipe. The combustion pipe may be configured to heat the water in the water and steam volume.

19 Claims, 15 Drawing Sheets

Related U.S. Application Data which is a continuation-in-part of application No. PCT/US2015/012843, filed on Jan. 26, 2015, and a continuation-in-part of application No. PCT/US2014/057075, filed on Sep. 23, 2014, and a continuation-in-part of application No. PCT/US2014/016632, filed on Feb. 14, 2014, and a continuation-in-part of application No. PCT/US2014/016622, filed on Feb. 14, 2014, said application No. PCT/US2014/057075 is a continuation-in-part of application No. PCT/US2014/016632, filed on Feb. 14, 2014.

(60) Provisional application No. 62/798,913, filed on Jan. 30, 2019, provisional application No. 61/931,407, filed on Jan. 24, 2014, provisional application No. 61/887,741, filed on Oct. 7, 2013, provisional application No. 61/765,022, filed on Feb. 14, 2013.

(51) Int. Cl.
*F23C 6/02* (2006.01)
*F23C 99/00* (2006.01)

(58) Field of Classification Search
CPC .. F23D 2203/102; F23D 11/383; F23D 14/12; F23D 14/70; F23D 14/10; F23D 14/02; F23D 9/00; F23D 14/22; F23D 14/58; F23D 14/26; F23D 1/0033; F23C 9/08
See application file for complete search history.

(56) References Cited

U.S. PATENT DOCUMENTS 2,635,813 A 4/1953 Schlenz
2,828,813 A 4/1958 Holden
3,008,513 A 11/1961 Holden
3,269,446 A 8/1966 Luther
3,306,338 A 2/1967 Wright et al.
3,324,924 A 6/1967 Hailstone et al.
3,638,621 A 2/1972 Craig
3,848,573 A 11/1974 Phillips
4,021,188 A 5/1977 Yamagishi et al.
4,081,958 A 4/1978 Schelp
4,111,636 A 9/1978 Goldberg
4,195,596 A 4/1980 Scheifley et al.
4,408,461 A 10/1983 Bruhwiler et al.
4,443,182 A * 4/1984 Wojcieson ..... F23C 7/00 431/183
4,473,349 A * 9/1984 Kumatsu ..... F23M 9/06 431/116
4,483,673 A 11/1984 Murai et al.
4,519,770 A * 5/1985 Kesselring ..... F23D 14/18 122/4 D
4,588,373 A 5/1986 Tonon et al.
4,627,388 A 12/1986 Buice
4,643,667 A 2/1987 Fleming
4,673,349 A 6/1987 Abe et al.
4,724,671 A 2/1988 Lapergue et al.
4,726,767 A 2/1988 Nakajima
4,752,213 A * 6/1988 Grochowski ..... F23D 14/02 431/328
4,773,847 A 9/1988 Shukla et al.
4,850,862 A 7/1989 Bjerklie
5,235,667 A 8/1993 Canfield et al.
5,275,552 A 1/1994 Schwartz et al.
5,326,257 A 7/1994 Taylor et al.
5,375,999 A 12/1994 Aizawa et al.
5,409,375 A 4/1995 Butcher
5,441,402 A 8/1995 Reuther et al.
5,511,516 A 4/1996 Moore, Jr. et al.
5,641,282 A 6/1997 Lee et al.
5,667,374 A 9/1997 Nutcher et al.
5,718,573 A * 2/1998 Knight ..... F23D 14/62 126/116 R
5,784,889 A 7/1998 Joos et al.
5,846,067 A 12/1998 Nishiyama et al.
5,957,682 A 9/1999 Kamal et al.
5,993,192 A 11/1999 Schmidt et al.
6,159,001 A 12/2000 Kushch et al.
6,210,151 B1 4/2001 Joshi et al.
6,270,336 B1 8/2001 Terashima et al.
6,287,111 B1 9/2001 Gensler
6,499,990 B1 12/2002 Zink et al.
6,752,620 B2 6/2004 Heier et al.
6,997,701 B2 2/2006 Volkert et al.
7,137,808 B2 11/2006 Branston et al.
7,243,496 B2 7/2007 Pavlik et al.
7,410,288 B1 8/2008 Kelso et al.
7,878,798 B2 2/2011 Poe et al.
8,851,882 B2 10/2014 Hartwick et al.
8,881,535 B2 11/2014 Hartwick et al.
8,911,699 B2 12/2014 Colannino et al.
9,151,549 B2 10/2015 Goodson et al.
9,209,654 B2 12/2015 Colannino et al.
9,243,800 B2 1/2016 Goodson et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,190 B2 6/2016 Karkow et al.
9,377,195 B2 6/2016 Goodson et al.
9,388,981 B2 7/2016 Karkow et al.
2001/0046649 A1 11/2001 Schutz et al.
2002/0155403 A1 10/2002 Griffin et al.
2002/0197574 A1* 12/2002 Jones ..... F23D 14/02 431/8
2003/0054313 A1 3/2003 Rattner et al.
2004/0058290 A1* 3/2004 Mauzey ..... F23D 11/441 431/243
2004/0081933 A1 4/2004 St. Charles et al.
2004/0197719 A1 10/2004 Chung et al.
2005/0106520 A1 5/2005 Cornwell et al.
2005/0208442 A1 9/2005 Heiligers et al.
2006/0084017 A1 4/2006 Huebner et al.
2006/0141413 A1 6/2006 Masten et al.
2006/0292510 A1 12/2006 Krauklis et al.
2008/0124666 A1 5/2008 Stocker et al.
2008/0131824 A1 6/2008 Wahl et al.
2009/0111063 A1* 4/2009 Boardman ..... F23R 3/36 431/8
2009/0307922 A1* 12/2009 Kim ..... D06F 58/263 34/86
2010/0126175 A1 5/2010 Kim et al.
2010/0178219 A1 7/2010 Verykios et al.
2011/0076628 A1 3/2011 Miura et al.
2011/0076629 A1 3/2011 Mosiewicz
2012/0064465 A1 3/2012 Borissov et al.
2012/0116589 A1 5/2012 Schneider et al.
2012/0164590 A1 6/2012 Mach
2012/0231398 A1 9/2012 Carpentier et al.
2013/0230810 A1 9/2013 Goodson et al.
2013/0260321 A1 10/2013 Colannino et al.

(56) References Cited

U.S. PATENT DOCUMENTS

| | | | | |
|---|---|---|---|---|
| 2013/0323655 | A1 | 12/2013 | Krichlalovitch et al. | |
| 2013/0323661 | A1 | 12/2013 | Goodson et al. | |
| 2013/0333279 | A1 | 12/2013 | Osler et al. | |
| 2013/0336352 | A1 | 12/2013 | Colannino et al. | |
| 2014/0051030 | A1 | 2/2014 | Colannino et al. | |
| 2014/0065558 | A1 | 3/2014 | Colannino et al. | |
| 2014/0076212 | A1 | 3/2014 | Goodson et al. | |
| 2014/0080070 | A1 | 3/2014 | Krichlalovitch et al. | |
| 2014/0162195 | A1 | 6/2014 | Lee et al. | |
| 2014/0162196 | A1 | 6/2014 | Krichlalovitch et al. | |
| 2014/0162197 | A1 | 6/2014 | Krichlalovitch et al. | |
| 2014/0162198 | A1 | 6/2014 | Krichlalovitch et al. | |
| 2014/0170569 | A1 | 6/2014 | Anderson et al. | |
| 2014/0170571 | A1 | 6/2014 | Casasanta, III et al. | |
| 2014/0170575 | A1 | 6/2014 | Krichlalovitch | |
| 2014/0170576 | A1 | 6/2014 | Colannino et al. | |
| 2014/0170577 | A1 | 6/2014 | Colannino et al. | |
| 2014/0186778 | A1 | 7/2014 | Colannino et al. | |
| 2014/0196368 | A1 | 7/2014 | Wiklof | |
| 2014/0196369 | A1 | 7/2014 | Wiklof | |
| 2014/0208758 | A1 | 7/2014 | Breidenthal et al. | |
| 2014/0212820 | A1 | 7/2014 | Colannino et al. | |
| 2014/0216401 | A1 | 8/2014 | Colannino et al. | |
| 2014/0227645 | A1 | 8/2014 | Krichlalovitch et al. | |
| 2014/0227646 | A1 | 8/2014 | Krichlalovitch et al. | |
| 2014/0227649 | A1 | 8/2014 | Krichlalovitch et al. | |
| 2014/0248566 | A1 | 9/2014 | Krichlalovitch et al. | |
| 2014/0255855 | A1 | 9/2014 | Krichlalovitch | |
| 2014/0255856 | A1 | 9/2014 | Colannino et al. | |
| 2014/0272730 | A1 | 9/2014 | Krichlalovitch et al. | |
| 2014/0272731 | A1 | 9/2014 | Breidenthal et al. | |
| 2014/0287368 | A1 | 9/2014 | Krichlalovitch et al. | |
| 2014/0295094 | A1 | 10/2014 | Casasanta, III | |
| 2014/0295360 | A1 | 10/2014 | Wiklof | |
| 2014/0335460 | A1 | 11/2014 | Wiklof et al. | |
| 2015/0079524 | A1 | 3/2015 | Colannino et al. | |
| 2015/0104748 | A1 | 4/2015 | Dumas et al. | |
| 2015/0107260 | A1 | 4/2015 | Colannino et al. | |
| 2015/0118629 | A1 | 4/2015 | Colannino et al. | |
| 2015/0121890 | A1 | 5/2015 | Colannino et al. | |
| 2015/0140498 | A1 | 5/2015 | Colannino | |
| 2015/0147704 | A1 | 5/2015 | Krichlalovitch et al. | |
| 2015/0147705 | A1 | 5/2015 | Colannino et al. | |
| 2015/0147706 | A1 | 5/2015 | Krichlalovitch et al. | |
| 2015/0219333 | A1 | 8/2015 | Colannino et al. | |
| 2015/0226424 | A1 | 8/2015 | Breidenthal et al. | |
| 2015/0241057 | A1 | 8/2015 | Krichlalovitch et al. | |
| 2015/0276211 | A1 | 10/2015 | Colannino et al. | |
| 2015/0276217 | A1 | 10/2015 | Karkow et al. | |
| 2015/0276220 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0338089 | A1 | 11/2015 | Krichlalovitch et al. | |
| 2015/0345780 | A1 | 12/2015 | Krichlalovitch | |
| 2015/0345781 | A1 | 12/2015 | Krichlalovitch et al. | |
| 2015/0362177 | A1 | 12/2015 | Krichlalovitch et al. | |
| 2015/0362178 | A1 | 12/2015 | Karkow et al. | |
| 2015/0369476 | A1 | 12/2015 | Wiklof | |
| 2015/0369477 | A1 | 12/2015 | Karkow et al. | |
| 2016/0003471 | A1* | 1/2016 | Karkow | F23D 14/78 431/2 |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0033125 | A1 | 2/2016 | Krichlalovitch et al. | |
| 2016/0040872 | A1 | 2/2016 | Colannino et al. | |
| 2016/0046524 | A1* | 2/2016 | Colannino | C04B 7/361 44/628 |
| 2016/0047542 | A1 | 2/2016 | Wiklof et al. | |
| 2016/0091200 | A1 | 3/2016 | Colannino et al. | |
| 2016/0109118 | A1 | 4/2016 | Krichlalovitch et al. | |
| 2016/0123576 | A1 | 5/2016 | Colannino et al. | |
| 2016/0123577 | A1 | 5/2016 | Dumas et al. | |
| 2016/0138799 | A1 | 5/2016 | Colannino et al. | |
| 2016/0138800 | A1 | 5/2016 | Anderson et al. | |
| 2016/0161110 | A1 | 6/2016 | Krichlalovitch et al. | |
| 2016/0161115 | A1 | 6/2016 | Krichlalovitch et al. | |
| 2016/0215974 | A1 | 7/2016 | Wiklof | |
| 2016/0290639 | A1 | 10/2016 | Karkow et al. | |
| 2017/0307212 | A1 | 10/2017 | Kendrick | |
| 2018/0038588 | A1 | 2/2018 | Karkow et al. | |
| 2018/0038589 | A1* | 2/2018 | Karkow | F23D 14/82 |
| 2018/0066846 | A1* | 3/2018 | Karkow | F23D 14/14 |
| 2018/0087774 | A1* | 3/2018 | Karkow | F23N 5/265 |
| 2018/0202653 | A1* | 7/2018 | Karkow | F23C 5/06 |
| 2019/0011123 | A1* | 1/2019 | Dansie | F23D 11/406 |
| 2019/0049107 | A1* | 2/2019 | Colannino | F23D 14/70 |
| 2019/0257516 | A1* | 8/2019 | Karkow | F23D 14/16 |
| 2020/0191385 | A1* | 6/2020 | Carroll | F23D 14/64 |

FOREIGN PATENT DOCUMENTS

| | | |
|---|---|---|
| CN | 101294714 | 10/2008 |
| DE | 10 2009 028624 A1 | 2/2011 |
| EP | 0223691 A1 | 5/1987 |
| EP | 0478305 | 12/1997 |
| EP | 0844434 | 5/1998 |
| EP | 0672868 | 6/2000 |
| EP | 1916477 | 4/2008 |
| EP | 2738460 | 6/2014 |
| JP | 60-073242 | 4/1985 |
| JP | 06-026624 | 2/1994 |
| JP | H 07-48136 | 2/1995 |
| JP | 07-083076 | 3/1995 |
| JP | 2006-275482 | 10/2006 |
| WO | WO 1995/000803 | 1/1995 |
| WO | WO 2012/109499 | 8/2012 |
| WO | WO 2015/017084 | 2/2015 |
| WO | WO 2015/038245 | 3/2015 |
| WO | WO 2015/042566 | 3/2015 |
| WO | WO 2015/042614 | 3/2015 |
| WO | WO 2015/042615 | 3/2015 |
| WO | WO 2015/051136 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/003883 | 1/2016 |
| WO | WO 2016/007564 | 1/2016 |
| WO | WO 2016/018610 | 2/2016 |
| WO | WO 2016/105489 | 6/2016 |
| WO | WO 2018/160869 | 9/2018 |

OTHER PUBLICATIONS

EPO Extended Search Report and Search Opinion of EP Application No. 15739931.2 dated Sep. 21, 2017.

Fric, Thomas F., "Effects of Fuel-Air Unmixedness on NOx Emissions," Sep.-Oct. 1993. Journal of Propulsion and Power, vol. 9, No. 5, pp. 708-713.

Arnold Schwarzenegger, "A Low NOx Porous Ceramics Burner Performance Study," California Energy Commission Public Interest Energy Research Program, Dec. 2007, San Diego State University Foundation, p. 5.

M. Abdul Mujeebu et al., "Applications of Porous Media Combustion Technology—A Review." Applied Energy 86, 2009, pp. 1365-1375.

PCT International Search Report and Written Opinion of PCT Application No. PCT/US2015/012843 dated May 7, 2015.

PCT International Search Report and Written Opinion of PCT/US2014/057075 dated Jan. 14, 2015.

(56) References Cited

OTHER PUBLICATIONS

PCT International Search Report and Written Opinion of PCT/US2014/016632 dated May 26, 2014.
PCT International Search Report and Written Opinion of PCT/US2014/016622 dated May 27, 2014.
PCT International Search Report and Written Opinion dated Jun. 12, 2018, for PCT International Patent Application No. PCT/US2018/020485 filed Mar. 1, 2018, 30 pages.

* cited by examiner

ULTRA LOW EMISSIONS FIRETUBE BOILER BURNER

CROSS-REFERENCE TO RELATED APPLICATIONS

The present application is a U.S. Continuation-in-Part Patent Application of co-pending U.S. patent application Ser. No. 15/215,401, entitled "LOW NOx FIRE TUBE BOILER," filed Jul. 20, 2016. Co-pending U.S. patent application Ser. No. 15/215,401 is a U.S. Continuation-in-Part Patent Application which claims priority benefit under 35 U.S.C. § 120 (pre-AIA) from International Patent Application No. PCT/US2015/012843, entitled "LOW NOx FIRE TUBE BOILER," filed Jan. 26, 2015, now expired. International Patent Application No. PCT/US2015/012843 claims priority benefit from U.S. Provisional Patent Application No. 61/931,407, entitled "LOW NOx FIRE TUBE BOILER," filed Jan. 24, 2014.

Co-pending U.S. patent application Ser. No. 15/215,401 also is a Continuation-in-Part Patent Application of and claims priority to International Patent Application No. PCT/US2014/057075, entitled "HORIZONTALLY FIRED BURNER WITH A PERFORATED FLAME HOLDER," filed Sep. 23, 2014, now expired. International Patent Application No. PCT/US2014/057075 claims priority benefit from U.S. Provisional Patent Application No. 61/887,741, entitled "POROUS FLAME HOLDER FOR LOW NOx COMBUSTION", filed Oct. 7, 2013. International Patent Application No. PCT/US2014/057075 also is a Continuation-in-Part Patent Application of and claims priority to International Patent Application No. PCT/US2014/016632, entitled "FUEL COMBUSTION SYSTEM WITH A PERFORATED REACTION HOLDER", filed Feb. 14, 2014, now expired.

Co-pending U.S. patent application Ser. No. 15/215,401 also is a Continuation-in-Part Patent Application of and claims priority to International Patent Application No. PCT/US2014/016632, entitled "FUEL COMBUSTION SYSTEM WITH A PERFORATED REACTION HOLDER," filed Feb. 14, 2014, now expired. International Patent Application No. PCT/US2014/016632 claims priority benefit from U.S. Provisional Patent Application No. 61/765,022, entitled "PERFORATED FLAME HOLDER AND BURNER INCLUDING A PERFORATED FLAME HOLDER", filed Feb. 14, 2013. International Patent Application No. PCT/US2014/016632 also claims priority benefit from U.S. Provisional Patent Application No. 61/931,407, entitled "LOW NOx FIRE TUBE BOILER", filed Jan. 24, 2014.

Co-pending U.S. patent application Ser. No. 15/215,401 also is a Continuation-in-Part Patent Application of and claims priority to International Patent Application No. PCT/US2014/016622, entitled "STARTUP METHOD AND MECHANISM FOR A BURNER HAVING A PERFORATED FLAME HOLDER," filed Feb. 14, 2014, now expired. International Patent Application No. PCT/US2014/016622 claims priority benefit from U.S. Provisional Patent Application No. 61/765,022, entitled "PERFORATED FLAME HOLDER AND BURNER INCLUDING A PERFORATED FLAME HOLDER", filed Feb. 14, 2013. International Patent Application No. PCT/US2014/016622 also claims priority benefit from U.S. Provisional Patent Application No. 61/931,407, entitled "LOW NOx FIRE TUBE BOILER", filed Jan. 24, 2014.

The present application also claims priority benefit from U.S. Provisional Patent Application No. 62/798,913, entitled "ULTRA LOW EMISSIONS FIRETUBE BOILER BURNER," filed Jan. 30, 2019.

The present application is related to co-pending International Patent Application No. PCT/US2018/020485, entitled "COMBUSTION SYSTEM WITH PERFORATED FLAME HOLDER AND SWIRL STABILIZED PREHEATING FLAME," filed Mar. 1, 2018.

Each of the foregoing applications, to the extent not inconsistent with the disclosure herein, is incorporated by reference.

SUMMARY

According to an embodiment, a fired heater includes a fuel and combustion air source configured to output fuel and combustion air into a combustion volume wall defining a lateral extent of a combustion volume. The combustion volume wall may include a combustion pipe disposed to separate the combustion volume from a water and steam volume. The fired heater includes a mixing tube aligned to receive the fuel and combustion air from the fuel and combustion air source. The mixing tube may be separated from the combustion volume wall by a volume. The fired heater includes a bluff body flame holder aligned to receive a fuel and combustion air mixture from an outlet end of the mixing tube. The bluff body flame holder may be configured to hold a combustion reaction for heating the combustion volume wall. The combustion volume wall may be configured to heat a volume thermal load.

According to an embodiment, a fired heater includes a fuel and combustion air source configured to output fuel and combustion air into a combustion volume wall defining a lateral extent of a combustion volume. The combustion volume wall may include a combustion pipe disposed to separate the combustion volume from a water and steam volume. The fired heater includes a mixing tube aligned to receive the fuel and combustion air from the fuel and combustion air source. The mixing tube may be separated from the combustion volume wall by a volume. The fired heater includes a bluff body flame holder aligned to receive a fuel and combustion air mixture from an outlet end of the mixing tube. The bluff body flame holder may be configured to hold a combustion reaction for heating the combustion volume wall. The combustion volume wall may be configured to heat a volume thermal load.

According to an embodiment, a combustion system includes a frame configured to be suspended from an inner surface of a combustion volume wall, and one or more refractory bluff bodies supported by the frame. The combustion system includes a pilot burner configured to selectively support a pilot flame for heating the one or more refractory bluff bodies, and a secondary fuel source configured to supply secondary fuel to a combustion reaction held by the one or more refractory bluff bodies.

According to an embodiment, a fuel and air source for a burner may include a fuel riser extending to a tip, a wall of a primary combustion air plenum disposed around the fuel riser and defining a primary combustion air plenum chamber, and a variable swirler disposed to controllably cause primary combustion air to swirl at either of two or more different rotational velocities at at least a location corresponding to the tip of the fuel riser.

According to an embodiment, a method of operating a fired heater includes outputting fuel and combustion air from a fuel and combustion air source into a combustion volume wall defining a lateral extent of a combustion volume. In one embodiment, the fired heater is a boiler heater. The combustion volume wall may include a combustion pipe disposed to separate the combustion volume from a water and steam volume. The method may include receiving, from the fuel and combustion air source, the fuel and combustion air in a mixing tube aligned to receive the fuel and combustion air from the fuel and combustion air source. The mixing tube may be separated from the combustion volume wall by a separation volume. The method may include receiving, at a bluff body flame holder, a mixture of the fuel and combustion air from an outlet end of the mixing tube, holding a combustion reaction of the fuel and combustion air with the bluff body flame holder, heating the combustion pipe with the combustion reaction, and heating water in the in the water and steam volume with the combustion pipe.

According to an embodiment, a method includes suspending a frame from an inner surface of a combustion volume wall, supporting one or more refractory bluff bodies with the frame, selectively supporting a pilot flame with a pilot burner, heating the one or more refractory bluff bodies with the pilot flame when the pilot flame is present, supplying secondary fuel to the one or more refractory bluff bodies with a secondary fuel source, and holding a combustion reaction of the secondary fuel and combustion air with the one or more refractory bluff bodies.

According to an embodiment, a method of operating a fuel and air source for a burner includes outputting a primary fuel from a fuel riser extending to a tip, providing primary combustion air to a primary combustion air plenum chamber defined by a wall of a primary combustion air plenum disposed around the fuel riser and defining the primary combustion air plenum chamber, and swirling, with a variable swirler, the primary combustion air at either of two or more different rotational velocities at at least a location corresponding to the tip of the fuel riser.

DETAILED DESCRIPTION

Figure 1:
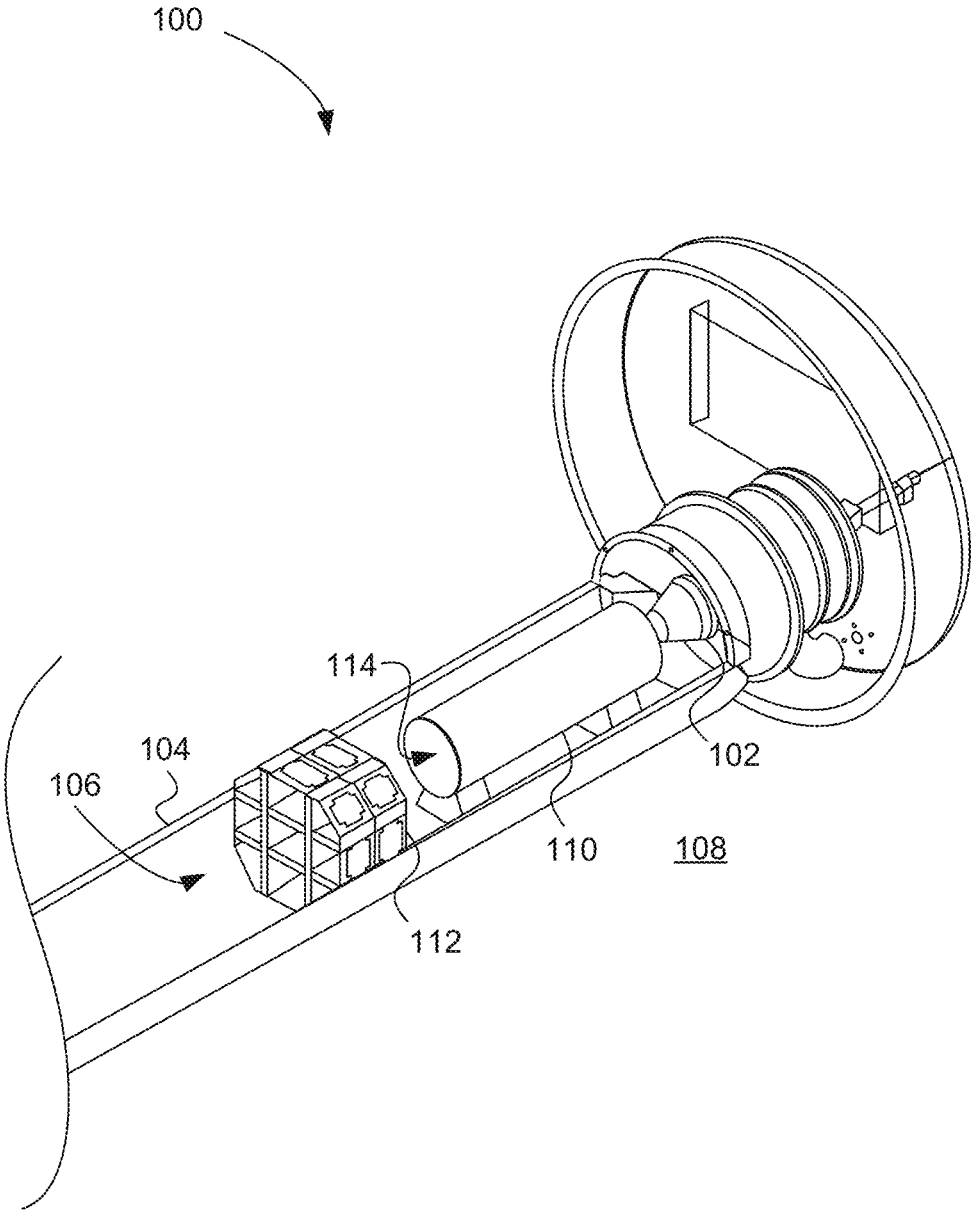
FIG. 1 is a cutaway view of a low emissions fired heater configured as a boiler heater, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

FIG. 1 is a cutaway view of a low emissions fired heater configured as a boiler heater 100, according to an embodiment.

Figure 2:
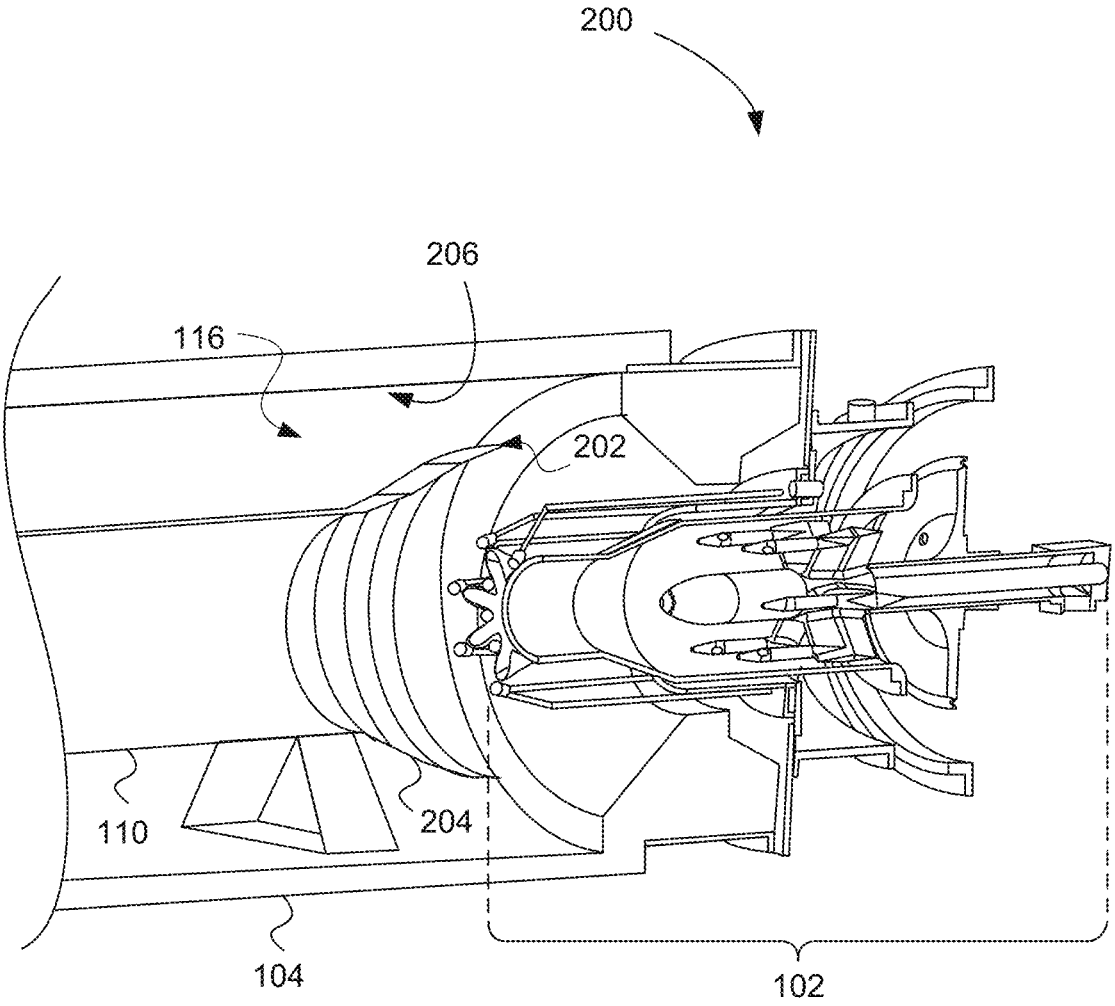
FIG. 2 is a close-up cutaway view of a portion of the low emissions boiler heater of FIG. 1, according to an embodiment.

FIG. 2 is a close-up cutaway view 200 of a portion of the low emissions fired heater 100 of FIG. 1, according to an embodiment.

Referring to FIGS. 1 and 2, the fired heater 100 may include a fuel and combustion air source 102 configured to output fuel and combustion air into a combustion volume wall 104 defining a lateral extent of a combustion volume 106. In an embodiment, the combustion volume wall may include a combustion pipe 104 disposed to separate the combustion volume 106 from a water and steam volume 108. According to an embodiment, the fired heater 100 may include a mixing tube 110 aligned to receive the fuel and combustion air from the fuel and combustion air source 102. The mixing tube 110 may be separated from the combustion volume wall 104 by a separation volume 116. According to an embodiment, the fired heater 100 may include a bluff body flame holder 112 aligned to receive a fuel and combustion air mixture from an outlet end 114 of the mixing tube 110. The bluff body flame holder 112 may be configured to hold a combustion reaction for heating the combustion volume wall 104. In an embodiment, the combustion volume wall 104 may be configured to heat a volume thermal load 108. The volume thermal load 108 can include a water and steam volume.

According to an embodiment, the separation volume 116 includes an annular volume between the mixing tube 110 and the combustion volume wall 104. In one embodiment, the mixing tube 110 and the combustion volume wall 104 are concentric. In another embodiment, the mixing tube 110 and the combustion volume wall 104 are not concentric. According to an embodiment, the separation volume 116, defined by the mixing tube 110 and the combustion volume wall 104, is disposed to carry flue gas for recirculation.

According to an embodiment, the mixing tube 110 further includes the inlet end 202 separated from the fuel and combustion air source 102. In one embodiment, the inlet end 202 of the mixing tube 110 may include a bell mouth 204 that tapers toward a cylindrical region of the mixing tube 110 away from the fuel and combustion air source 102. In another embodiment, the inlet end 202 of the mixing tube 110 may include the bell mouth 204 arranged to educe the flue gas that passes through the annular volume 116 from the outlet end 114 of the mixing tube 110 toward the inlet end 202 of the mixing tube 110.

According to an embodiment, an inner surface 206 of the combustion volume wall 104 may include a refractory material configured to provide thermal insulation.

According to an embodiment, the combustion volume wall 104 may be configured to be kept cool by the thermal load 108, such as by water in a water and steam volume 108, and the mixing tube 110 may be configured to be kept warm by the combustion reaction and the flue gas. In an embodiment, the cool temperature of the combustion volume wall 104 is configured to draw the flue gas produced by the combustion reaction from a region near the bluff body flame holder 112 toward an inlet end 202 of the mixing tube 110. The flue gas may be educed into the mixing tube 110 by a flow of the fuel and combustion air output by the fuel and combustion air source 102. In an embodiment, the mixing tube 110 is configured to cause the combustion air, the fuel, and the flue gas to mix while flowing through the mixing tube 110 to form a lean air and fuel mixture for supporting the combustion reaction. According to an embodiment, the fuel and combustion air source 102 may be configured to selectively hold a pilot flame.

Figure 3:
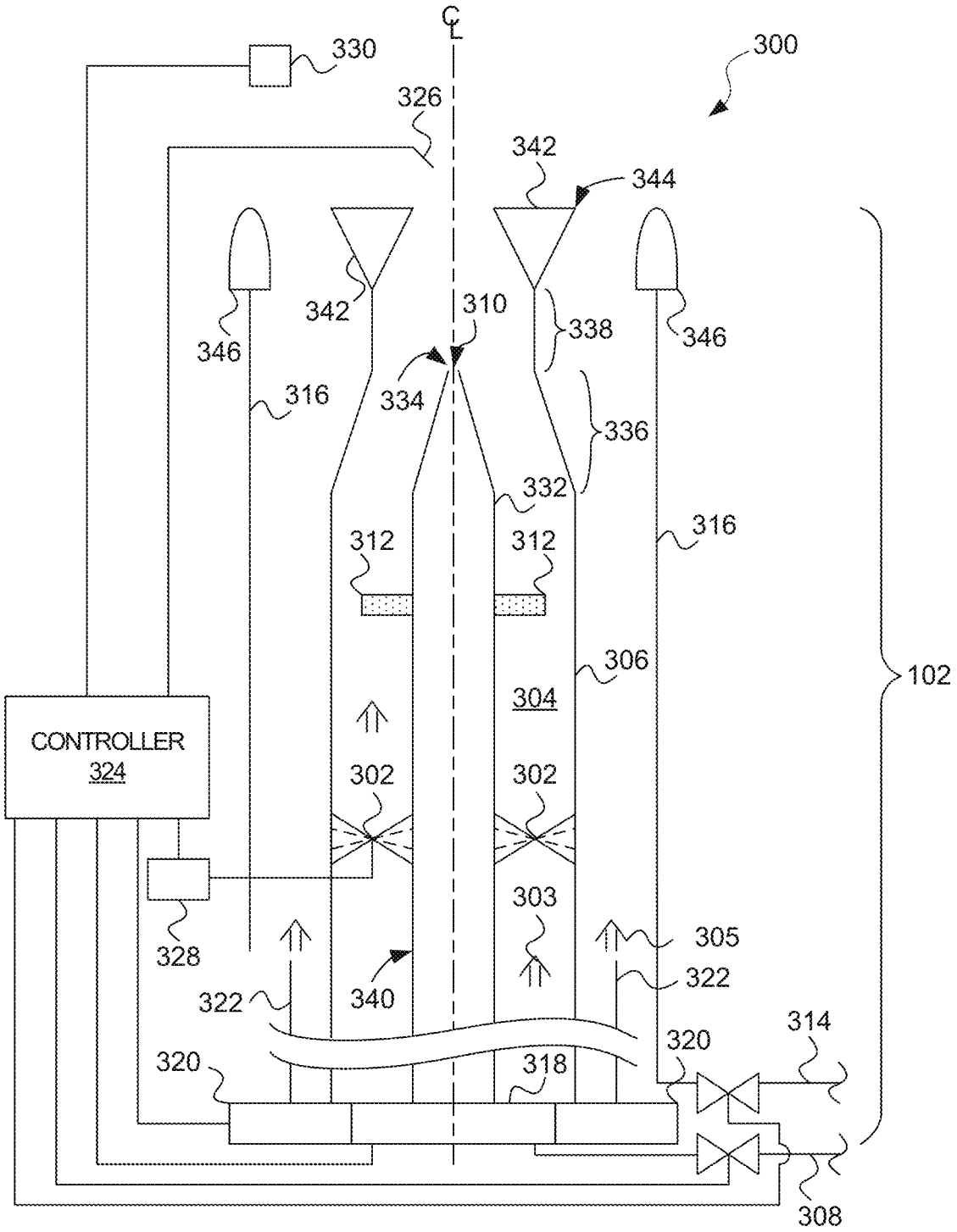
FIG. 3 is a side-sectional view of the combination fuel and combustion air source and pilot burner of FIGS. 1 and 2, according to an embodiment.

FIG. 3 is a side-sectional view 300 of the combination fuel and combustion air source and pilot burner 102 of FIGS. 1 and 2, according to an embodiment.

According to an embodiment, the fuel and combustion air source 102 includes a controllable swirler 302 configured to selectively apply a swirling motion to primary combustion air 303 that flows within a primary combustion air plenum chamber 304 defined by a primary combustion air plenum 306. The fuel and combustion air source 102 may be configured to selectively hold the pilot flame when the controllable swirler 302 selectively applies the swirling motion to the primary combustion air 303.

According to an embodiment, the fuel and combustion air source 102 may include the primary combustion air plenum 306, a first fuel circuit 308 configured to selectively output primary fuel to one or more locations 310, 312 within the primary combustion air plenum 306, and a second fuel circuit 314 configured to selectively output secondary fuel through a plurality of fuel risers 316 disposed outside the primary combustion air plenum 306. In an embodiment, the fuel and combustion air source 102 may be configured to supply fuel and combustion air to the bluff body flame holder 112 when the first fuel circuit 308 is stopped and when the second fuel circuit 314 is opened. The fuel and combustion air source 102 may be configured to support the pilot flame when the first fuel circuit 308 is opened and when the second fuel circuit 314 is closed.

In an embodiment, the pilot flame may be configured to heat the bluff body flame holder 112 to an operating temperature when the fuel and combustion air source 102 holds the pilot flame. In another embodiment, the fuel and combustion air source 102 may be configured to output fuel and combustion air through the mixing tube 110 to the bluff body flame holder 112 when the fuel and combustion air source 102 does not hold the pilot flame.

According to an embodiment, the fuel and combustion air source 102 includes a first combustion air damper 318 configured to control a flow of the primary combustion air 303 through the primary combustion air plenum 306. In another embodiment, the fuel and combustion air source 102 includes a second combustion air damper 320 configured to control secondary combustion air through a secondary combustion air plenum 322.

According to an embodiment, the fired heater 100 further includes a burner controller 324 configured to control at least one selected from the group consisting of an actuator 328 operatively coupled to the variable swirler 302, the first fuel circuit 308, the second fuel circuit 314, the first combustion air damper 318, the second combustion air damper 320, and an igniter 326. In an embodiment, the burner controller 324 is operatively coupled to a combustion sensor 330.

Figure 4:
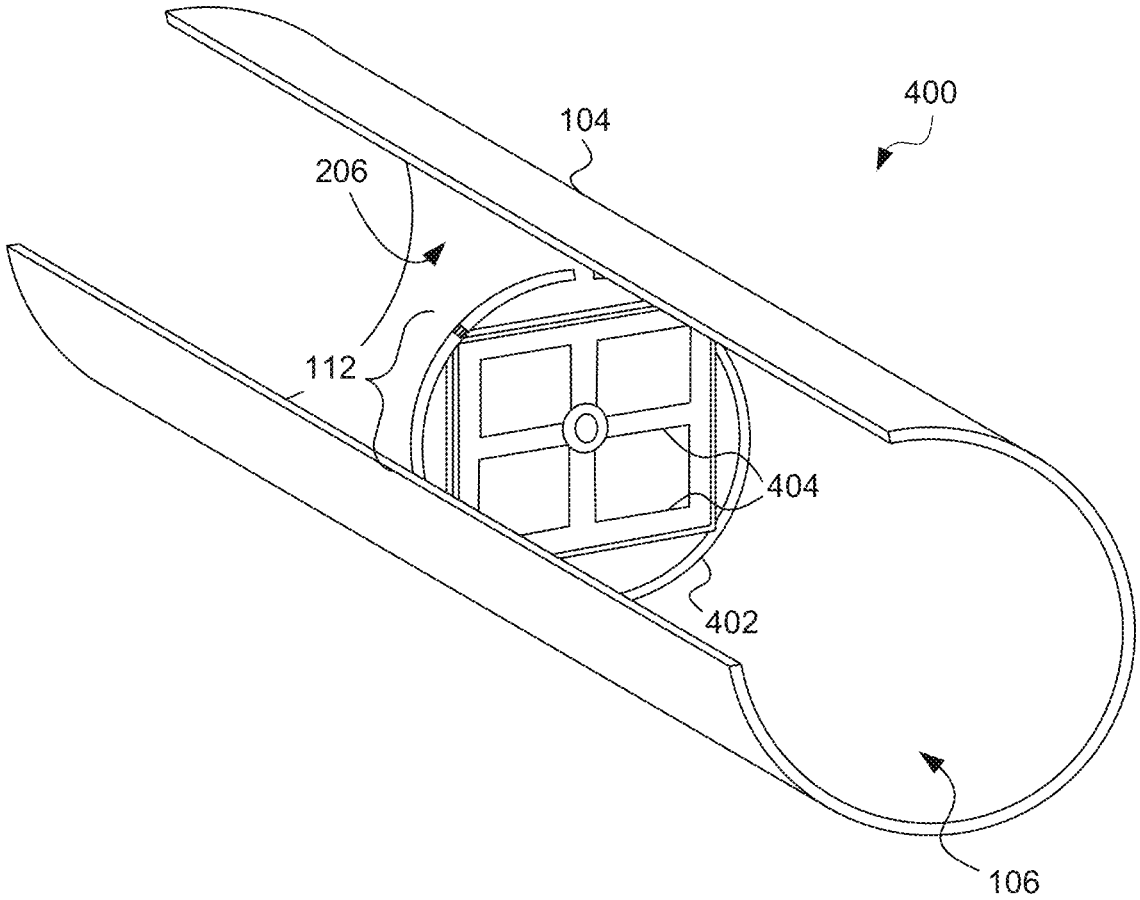
FIG. 4 is a diagram of a flame holding section of the combustion system of FIG. 1, according to an embodiment.

FIG. 4 is a diagram of a flame holding section 400 of the combustion system of FIG. 1, according to an embodiment.

According to an embodiment, the fired heater 100 further includes a frame 402 configured to be suspended from the inner surface 206 of the combustion volume wall 104. In an embodiment, the frame 402 is configured to support the bluff body flame holder 112 within the combustion volume wall 104. In one embodiment, the bluff body flame holder 112 includes one or more perforated flame holders. The one or more perforated flame holders may include a reticulated ceramic perforated flame holder. In another embodiment, the bluff body flame holder 112 includes one or more bluff bodies 404. In an embodiment, the frame 402 and the one or more bluff bodies 404 supported by the frame 402 include a plurality of frames 402 supporting respective pluralities of bluff body tiles 404, each frame 402 being disposed at a different respective distance from the fuel and combustion air source 102. In another embodiment, the frame 402 and one or more refractory bluff bodies 404 supported by the frame 402 include a single frame 402 supporting a plurality of bluff body tiles 404. In one embodiment, the bluff body flame holder 112 is a refractory material. The one or more bluff bodies can include two or more bluff bodies.

According to an embodiment, the frame 402 and the one or more refractory bluff bodies 404 supported by the frame 402 include a plurality of frames 402 supporting the respective pluralities of bluff body tiles 404, each frame 402 being disposed at a different respective distance from the pilot burner of the fuel and combustion air source 102.

Referring back to FIG. 3, according to an embodiment, the fuel and combustion air source 102 includes a fuel riser 332 extending to a tip 334. The primary combustion air plenum 306 includes a wall disposed around the fuel riser 332. The wall defines the primary combustion air plenum chamber 304. The variable swirler 302 is disposed to controllably cause the primary combustion air 303 to swirl at either of two or more different rotational velocities at at least a location corresponding to the tip 334 of the fuel riser 332.

According to an embodiment, the wall of the primary combustion air plenum 306 forms a tapered region at an outlet end of the primary combustion air plenum 306 near the tip 334 of the fuel riser 332.

According to an embodiment, the fuel and combustion air source 102 includes a lobe mixer disposed to increase radial mixing of the fuel, air, and flue gas recirculated from the combustion reaction.

Figure 5A:
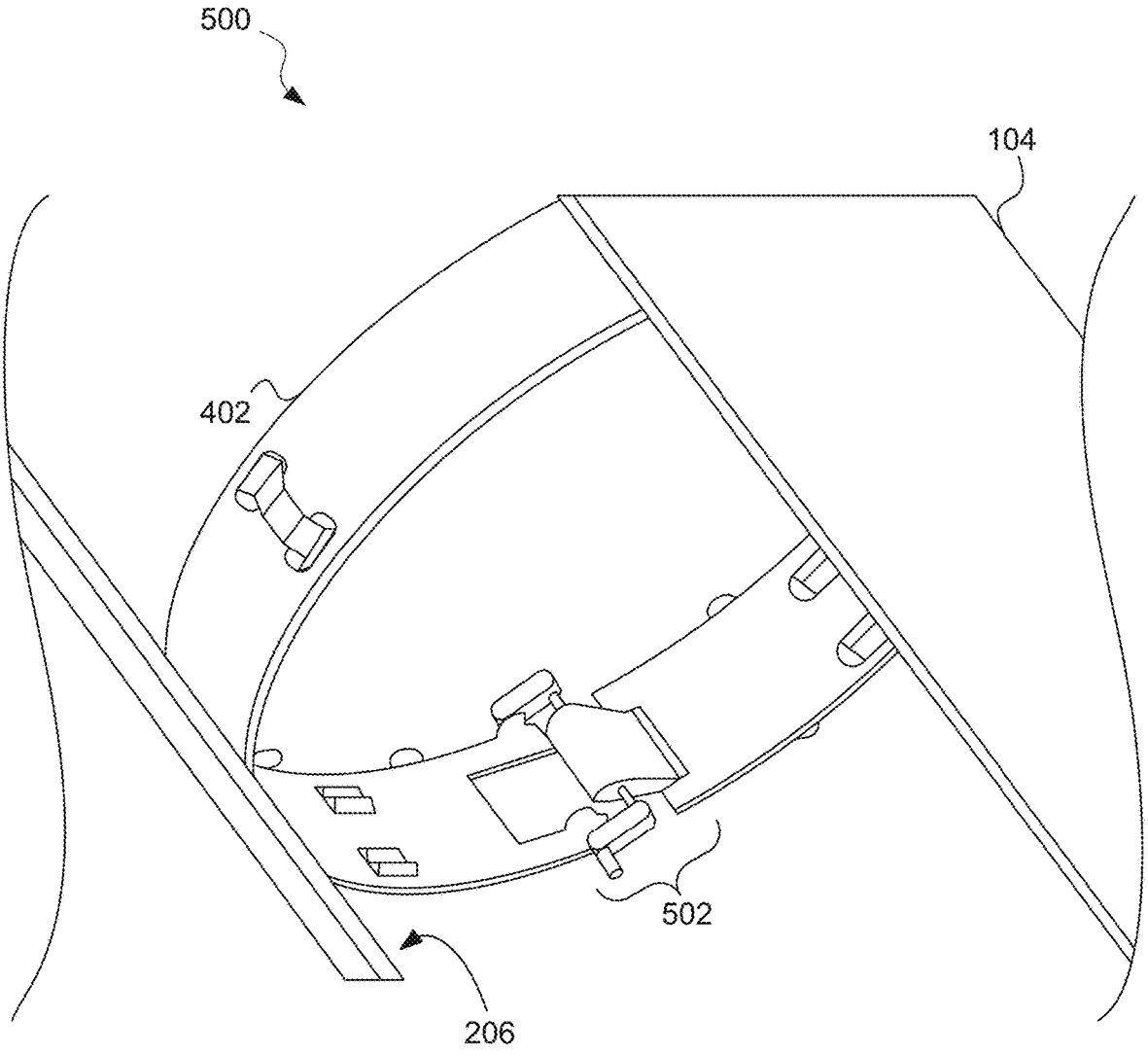
FIG. 5A is a diagram of a frame portion of the bluff body flame holder of FIGS. 1 and 4, according to an embodiment.

FIG. 5A is a diagram 500 of the frame 402 portion of the bluff body flame holder 112 of FIGS. 1 and 4, according to an embodiment.

Figure 5B:
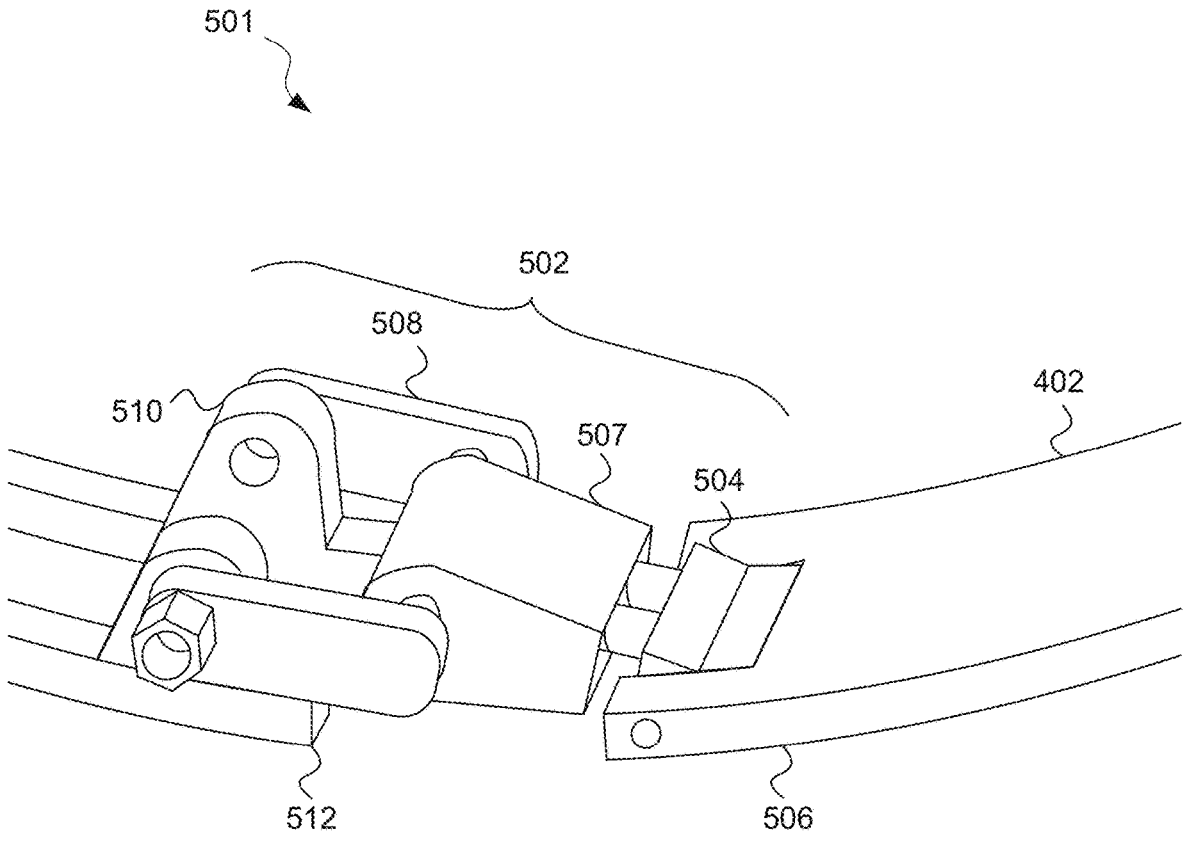
FIG. 5B is a detail view of the frame portion of the bluff body flame holder of FIGS. 4 and 5A, according to an embodiment.

FIG. 5B is a detail view 501 of the frame 402 portion of the bluff body flame holder 112 of FIGS. 4 and 5A, according to an embodiment.

Referring to FIGS. 1, 2, 3, 4, 5A, and 5B, a combustion system may include a frame 402 configured to be suspended from an inner surface 206 of a combustion volume wall 104, one or more refractory bluff bodies 404 supported by the frame 402, a pilot burner configured to selectively support a pilot flame for heating the one or more refractory bluff bodies 404, and a secondary fuel source, e.g., the secondary fuel risers 316, configured to supply secondary fuel to a combustion reaction held by the one or more refractory bluff bodies 404.

According to an embodiment, the secondary fuel source is actuatable to supply the secondary fuel when the pilot burner is selected to not support the pilot flame.

According to an embodiment, at least a portion of the one or more refractory bluff bodies 404 may include one or more perforated flame holders. In an embodiment, the one or more perforated flame holders are configured to support the combustion reaction of the fuel and the oxidant upstream, downstream, and within the perforated flame holders.

Figure 6:
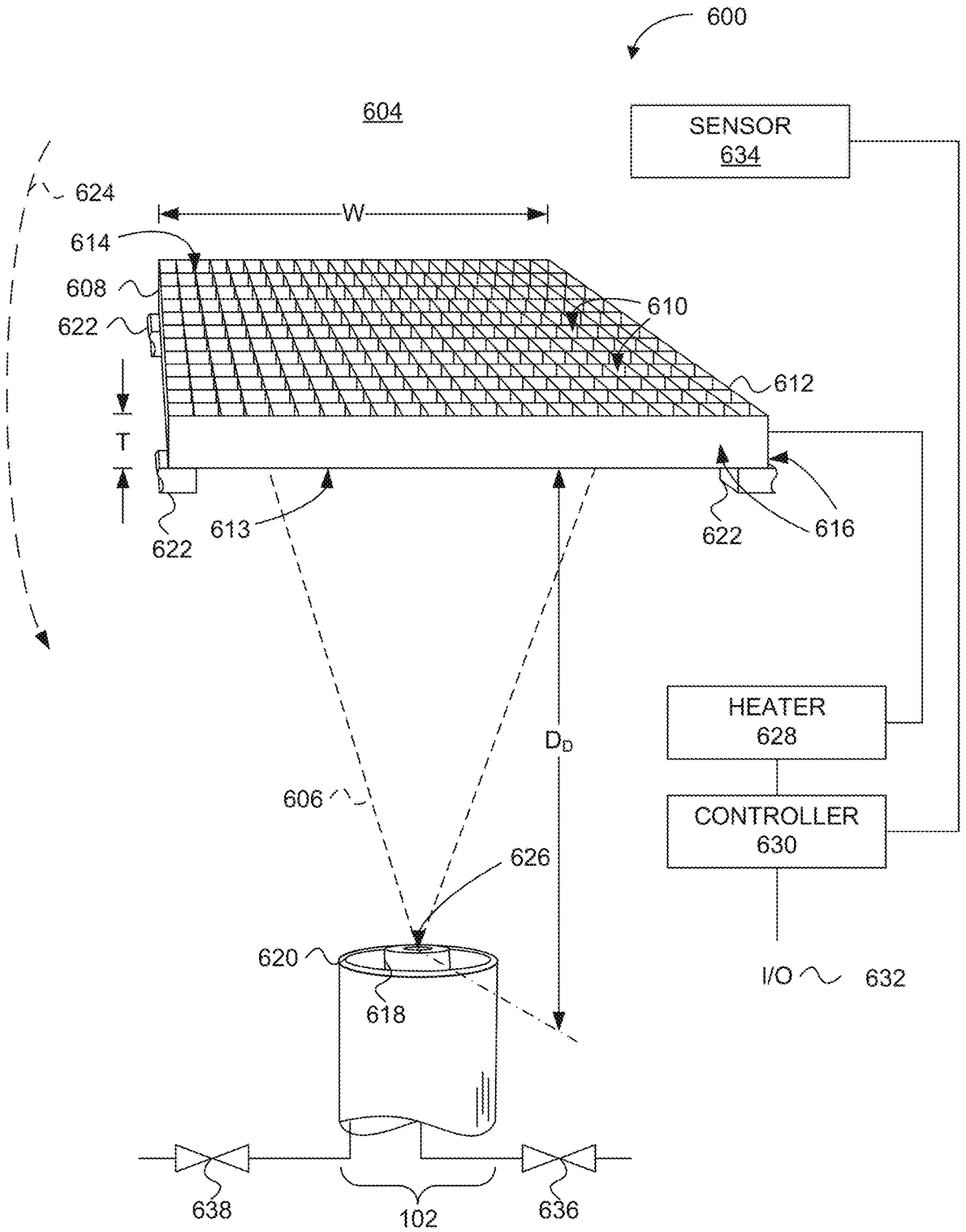
FIG. 6 is a simplified diagram of a burner system including a perforated flame holder configured to hold a combustion reaction, according to an embodiment.

FIG. 6 is a simplified diagram of a burner system 600 including a perforated flame holder 612 configured to hold a combustion reaction, according to an embodiment. The perforated flame holder 612 is one example of a bluff body flame holder 112 and can be implemented as the bluff body flame holder 112 of FIGS. 1, 4, and 10, in some embodiments. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 612 described herein can support very clean combustion. Specifically, in experimental use of burner systems 600 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 600 includes a fuel and oxidant source 102 disposed to output fuel and oxidant into a combustion volume 604 to form a fuel and oxidant mixture 606. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 612 is disposed in the combustion volume 604 and positioned to receive the fuel and oxidant mixture 606.

Figure 7:
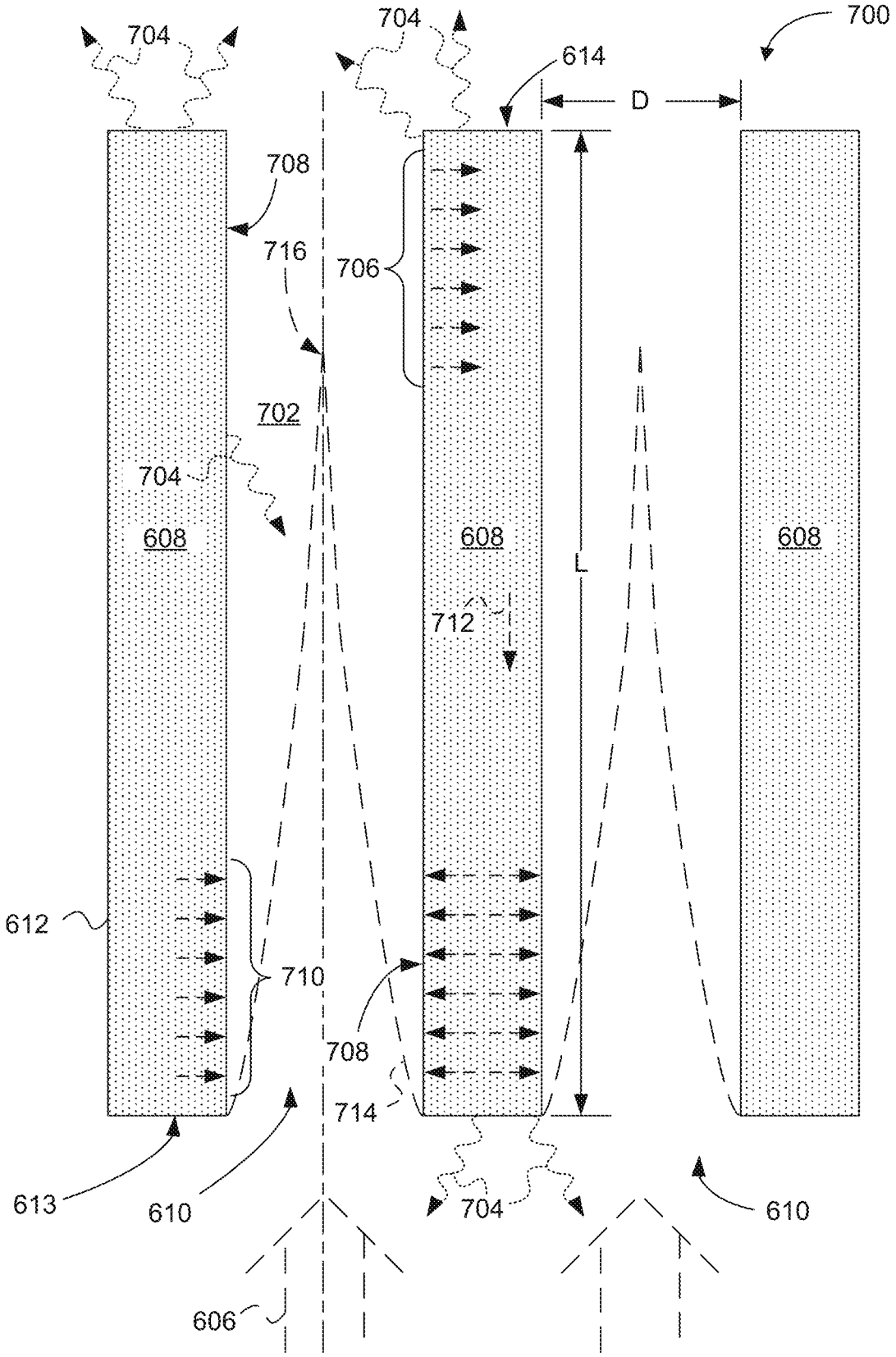
FIG. 7 is a side sectional diagram of a portion of the perforated flame holder of FIG. 6, according to an embodiment.

FIG. 7 is a side sectional diagram 700 of a portion of the perforated flame holder 612 of FIG. 6, according to an embodiment. Referring to FIGS. 6 and 7, the perforated flame holder 612 includes a perforated flame holder body 608 defining a plurality of perforations 610 aligned to receive the fuel and oxidant mixture 606 from the fuel and oxidant source 102. As used herein, the terms perforation, pore, aperture, elongated aperture, and the like, in the context of the perforated flame holder 612, shall be considered synonymous unless further definition is provided. The perforations 610 are configured to collectively hold a combustion reaction 702 supported by the fuel and oxidant mixture 606.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 608 can be bounded by an input face 613 disposed to receive the fuel and oxidant mixture 606, an output face 614 facing away from the fuel and oxidant source 102, and a peripheral surface 616 defining a lateral extent of the perforated flame holder 612. The plurality of perforations 610 which are defined by the perforated flame holder body 608 extend from the input face 613 to the output face 614. The plurality of perforations 610 can receive the fuel and oxidant mixture 606 at the input face 613. The fuel and oxidant mixture 606 can then combust in or near the plurality of perforations 610 and combustion products can exit the plurality of perforations 610 at or near the output face 614.

According to an embodiment, the perforated flame holder 612 is configured to hold a majority of the combustion reaction 702 within the perforations 610. For example, on a steady-state basis, more than half the molecules of fuel output into the combustion volume 604 by the fuel and oxidant source 102 may be converted to combustion products between the input face 613 and the output face 614 of the perforated flame holder 612. According to an alternative interpretation, more than half of the heat or thermal energy output by the combustion reaction 702 may be output between the input face 613 and the output face 614 of the perforated flame holder 612. As used herein, the terms heat, heat energy, and thermal energy shall be considered synonymous unless further definition is provided. As used above, heat energy and thermal energy refer generally to the released chemical energy initially held by reactants during the combustion reaction 702. As used elsewhere herein, heat, heat energy and thermal energy correspond to a detectable temperature rise undergone by real bodies characterized by heat capacities. Under nominal operating conditions, the perforations 610 can be configured to collectively hold at least 80% of the combustion reaction 702 between the input face 613 and the output face 614 of the perforated flame holder 612. In some experiments, the inventors produced a combustion reaction 702 that was apparently wholly contained in the perforations 610 between the input face 613 and the output face 614 of the perforated flame holder 612. According to an alternative interpretation, the perforated flame holder 612 can support combustion between the input face 613 and output face 614 when combustion is "time-averaged." For example, during transients, such as before the perforated flame holder 612 is fully heated, or if too high a (cooling) load is placed on the system, the combustion may travel somewhat downstream from the output face 614 of the perforated flame holder 612. Alternatively, if the cooling load is relatively low and/or the furnace temperature reaches a high level, the combustion may travel somewhat upstream of the input face 613 of the perforated flame holder 612.

While a "flame" is described in a manner intended for ease of description, it should be understood that in some instances, no visible flame is present. Combustion occurs primarily within the perforations 610, but the "glow" of combustion heat is dominated by a visible glow of the perforated flame holder 612 itself. In other instances, the inventors have noted transient "huffing" or "flashback" wherein a visible flame momentarily ignites in a region lying between the input face 613 of the perforated flame holder 612 and the fuel nozzle 618, within the dilution region $D_D$. Such transient huffing or flashback is generally short in duration such that, on a time-averaged basis, a majority of combustion occurs within the perforations 610 of the perforated flame holder 612, between the input face 613 and the output face 614. In still other instances, the inventors have noted apparent combustion occurring downstream from the output face 614 of the perforated flame holder 612, but still a majority of combustion occurred within the perforated flame holder 612 as evidenced by continued visible glow from the perforated flame holder 612 that was observed.

The perforated flame holder 612 can be configured to receive heat from the combustion reaction 702 and output a portion of the received heat as thermal radiation 704 to heat-receiving structures (e.g., furnace walls and/or radiant section working fluid tubes) in or adjacent to the combustion volume 604. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 608.

Referring especially to FIG. 7, the perforated flame holder 612 outputs another portion of the received heat to the fuel and oxidant mixture 606 received at the input face 613 of the perforated flame holder 612. The perforated flame holder body 608 may receive heat from the combustion reaction 702 at least in heat receiving regions 706 of perforation walls 708. Experimental evidence has suggested to the inventors that the position of the heat receiving regions 706, or at least the position corresponding to a maximum rate of receipt of heat, can vary along the length of the perforation walls 708. In some experiments, the location of maximum receipt of heat was apparently between ⅓ and ½ of the distance from the input face 613 to the output face 614 (i.e., somewhat nearer to the input face 613 than to the output face 614). The inventors contemplate that the heat receiving regions 706 may lie nearer to the output face 614 of the perforated flame holder 612 under other conditions. Most probably, there is no clearly defined edge of the heat receiving regions 706 (or for that matter, the heat output regions 710, described below). For ease of understanding, the heat receiving regions 706 and the heat output regions 710 will be described as particular regions 706, 710.

The perforated flame holder body 608 can be characterized by a heat capacity. The perforated flame holder body 608 may hold thermal energy from the combustion reaction 702 in an amount corresponding to the heat capacity multiplied by temperature rise, and transfer the thermal energy from the heat receiving regions 706 to the heat output regions 710 of the perforation walls 708. Generally, the heat output regions 710 are nearer to the input face 613 than are the heat receiving regions 706. According to one interpretation, the perforated flame holder body 608 can transfer heat from the heat receiving regions 706 to the heat output regions 710 via the thermal radiation, depicted graphically as 704. According to another interpretation, the perforated flame holder body 608 can transfer heat from the heat receiving regions 706 to the heat output regions 710 via heat conduction along heat conduction paths 712. The inventors contemplate that multiple heat transfer mechanisms including conduction, radiation, and possibly convection may be operative in transferring heat from the heat receiving regions 706 to the heat output regions 710. In this way, the perforated flame holder 612 may act as a heat source to maintain the combustion reaction 702, even under conditions where the combustion reaction 702 would not be stable when supported from a conventional flame holder.

The inventors believe that the perforated flame holder 612 causes the combustion reaction 702 to begin within thermal boundary layers 714 formed adjacent to the walls 708 of the perforations 610. Insofar as combustion is generally understood to include a large number of individual reactions, and since a large portion of combustion energy is released within the perforated flame holder 612, it is apparent that at least a majority of the individual reactions occur within the perforated flame holder 612. As the relatively cool fuel and oxidant mixture 606 approaches the input face 613, the flow is split into portions that respectively travel through the individual perforations 610. The hot perforated flame holder body 608 transfers heat to the fluid, notably within the thermal boundary layers 714 that progressively thicken as more and more heat is transferred to the incoming fuel and oxidant mixture 606. After reaching a combustion temperature (e.g., the auto-ignition temperature of the fuel), the reactants continue to flow while a chemical ignition delay time elapses, over which time the combustion reaction 702 occurs. Accordingly, the combustion reaction 702 is shown as occurring within the thermal boundary layers 714. As flow progresses, the thermal boundary layers 714 merge at a merger point 716. Ideally, the merger point 716 lies between the input face 613 and the output face 614 that define the ends of the perforations 610. At some position along the length of the perforation 610, the combustion reaction 702 outputs more heat to the perforated flame holder body 608 than it receives from the perforated flame holder body 608. The heat is received at the heat receiving region 706, is held by the perforated flame holder body 608, and is transported to the heat output region 710 nearer to the input face 613, where the heat is transferred into the cool reactants (and any included diluent) to bring the reactants to the ignition temperature.

In an embodiment, each of the perforations 610 is characterized by a length L defined as a reaction fluid propagation path length between the input face 613 and the output face 614 of the perforated flame holder 612. As used herein, the term reaction fluid refers to matter that travels through a perforation 610. Near the input face 613, the reaction fluid includes the fuel and oxidant mixture 606 (optionally including nitrogen, flue gas, and/or other "non-reactive" species). Within the combustion reaction 702 region, the reaction fluid may include plasma associated with the combustion reaction 702, molecules of reactants and their constituent parts, any non-reactive species, reaction intermediates (including transition states), and reaction products. Near the output face 614, the reaction fluid may include reaction products and byproducts, non-reactive gas, and excess oxidant.

The plurality of perforations 610 can be each characterized by a transverse dimension D between opposing perforation walls 708. The inventors have found that stable combustion can be maintained in the perforated flame holder 612 if the length L of each perforation 610 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for the thermal boundary layers 714 to form adjacent to the perforation walls 708 in a reaction fluid flowing through the perforations 610 to converge at the merger points 716 within the perforations 610 between the input face 613 and the output face 614 of the perforated flame holder 612. In experiments, the inventors have found L/D ratios between 12 and 48 to work well (i.e., produce low NOx, produce low CO, and maintain stable combustion).

The perforated flame holder body 608 can be configured to convey heat between adjacent perforations 610. The heat conveyed between adjacent perforations 610 can be selected to cause heat output from the combustion reaction portion 702 in a first perforation 610 to supply heat to stabilize a combustion reaction portion 702 in an adjacent perforation 610.

Referring especially to FIG. 6, the fuel and oxidant source 102 can further include the fuel nozzle 618, configured to output fuel, and an oxidant source 620 configured to output a fluid including the oxidant. For example, the fuel nozzle 618 can be configured to output pure fuel. The oxidant source 620 can be configured to output combustion air carrying oxygen, and optionally, flue gas.

The perforated flame holder 612 can be held by a perforated flame holder support structure 622 configured to hold the perforated flame holder 612 at a dilution distance $D_D$ away from the fuel nozzle 618. The fuel nozzle 618 can be configured to emit a fuel jet selected to entrain the oxidant to form the fuel and oxidant mixture 606 as the fuel jet and the oxidant travel along a path to the perforated flame holder 612 through the dilution distance $D_D$ between the fuel nozzle 618 and the perforated flame holder 612. Additionally or alternatively (particularly when a blower is used to deliver oxidant contained in combustion air), the oxidant or combustion air source 620 can be configured to entrain the fuel and the fuel and oxidant mixture 606 travel through the dilution distance $D_D$. In some embodiments, a flue gas recirculation path 624 can be provided. Additionally or alternatively, the fuel nozzle 618 can be configured to emit a fuel jet selected to entrain the oxidant and to entrain flue gas as the fuel jet travels through the dilution distance $D_D$ between the fuel nozzle 618 and the input face 613 of the perforated flame holder 612.

The fuel nozzle 618 can be configured to emit the fuel through one or more fuel orifices 626 having an inside diameter dimension that is referred to as "nozzle diameter." The perforated flame holder support structure 622 can support the perforated flame holder 612 to receive the fuel and oxidant mixture 606 at the distance $D_D$ away from the fuel nozzle 618 greater than 20 times the nozzle diameter. In another embodiment, the perforated flame holder 612 is disposed to receive the fuel and oxidant mixture 606 at the distance $D_D$ away from the fuel nozzle 618 between 100 times and 1100 times the nozzle diameter. Preferably, the perforated flame holder support structure 622 is configured to hold the perforated flame holder 612 at a distance about 200 times or more of the nozzle diameter away from the fuel nozzle 618. When the fuel and oxidant mixture 606 travels about 200 times the nozzle diameter or more, the fuel and oxidant mixture 606 is sufficiently homogenized to cause the combustion reaction 702 to produce minimal NOx.

The fuel and oxidant source 102 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 612 and be configured to prevent flame flashback into the premix fuel and oxidant source.

The oxidant source 620, whether configured for entrainment in the combustion volume 604 or for premixing, can include a blower configured to force the oxidant through the fuel and oxidant source 102.

The perforated flame holder support structure 622 can be configured to support the perforated flame holder 612 from a floor or wall (not shown) of the combustion volume 604, for example. In another embodiment, the perforated flame holder support structure 622 supports the perforated flame holder 612 from the fuel and oxidant source 102. Alternatively, the perforated flame holder support structure 622 can suspend the perforated flame holder 612 from an overhead structure (such as a flue, in the case of an up-fired system). The perforated flame holder support structure 622 can support the perforated flame holder 612 in various orientations and directions.

The perforated flame holder 612 can include a single perforated flame holder body 608. In another embodiment, the perforated flame holder 612 can include a plurality of adjacent perforated flame holder sections that collectively provide a tiled perforated flame holder 612.

The perforated flame holder support structure 622 can be configured to support the plurality of perforated flame holder sections. The perforated flame holder support structure 622 can include a metal superalloy, a cementatious, and/or ceramic refractory material. In an embodiment, the plurality of adjacent perforated flame holder sections can be joined with a fiber reinforced refractory cement.

The perforated flame holder 612 can have a width dimension W between opposite sides of the peripheral surface 616 at least twice a thickness dimension T between the input face 613 and the output face 614. In another embodiment, the perforated flame holder 612 can have a width dimension W between opposite sides of the peripheral surface 616 at least three times, at least six times, or at least nine times the thickness dimension T between the input face 613 and the output face 614 of the perforated flame holder 612.

In an embodiment, the perforated flame holder 612 can have a width dimension W less than a width of the combustion volume 604. This can allow the flue gas recirculation path 624 from above to below the perforated flame holder 612 to lie between the peripheral surface 616 of the perforated flame holder 612 and the combustion volume wall (not shown).

Referring again to both FIGS. 6 and 7, the perforations 610 can be of various shapes. In an embodiment, the perforations 610 can include elongated squares, each having a transverse dimension D between opposing sides of the squares. In another embodiment, the perforations 610 can include elongated hexagons, each having a transverse dimension D between opposing sides of the hexagons. In yet another embodiment, the perforations 610 can include hollow cylinders, each having a transverse dimension D corresponding to a diameter of the cylinder. In another embodiment, the perforations 610 can include truncated cones or truncated pyramids (e.g., frustums), each having a transverse dimension D radially symmetric relative to a length axis that extends from the input face 613 to the output face 614. In some embodiments, the perforations 610 can each have a lateral dimension D equal to or greater than a quenching distance of the flame based on standard reference conditions.

Alternatively, the perforations 610 may have lateral dimension D less then than a standard reference quenching distance.

In one range of embodiments, each of the plurality of perforations 610 has a lateral dimension D between 0.05 inch and 1.0 inch. Preferably, each of the plurality of perforations 610 has a lateral dimension D between 0.1 inch and 0.5 inch. For example, the plurality of perforations 610 can each have a lateral dimension D of about 0.2 to 0.4 inch.

The void fraction of a perforated flame holder 612 is defined as the total volume of all perforations 610 in a section of the perforated flame holder 612 divided by a total volume of the perforated flame holder 612 including perforated flame holder body 608 and perforations 610. The perforated flame holder 612 should have a void fraction between 0.10 and 0.90. In an embodiment, the perforated flame holder 612 can have a void fraction between 0.30 and 0.80. In another embodiment, the perforated flame holder 612 can have a void fraction of about 0.70. Using a void fraction of about 0.70 was found to be especially effective for producing very low NOx.

The perforated flame holder 612 can be formed from a fiber reinforced cast refractory material and/or a refractory material such as an aluminum silicate material. For example, the perforated flame holder 612 can be formed to include mullite or cordierite. Additionally or alternatively, the perforated flame holder body 608 can include a metal superalloy such as Inconel or Hastelloy. The perforated flame holder body 608 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 612 can be formed from VERSAGRID® ceramic honeycomb, available from Applied Ceramics, Inc. of Doraville, S.C.

The perforations 610 can be parallel to one another and normal to the input and the output faces 613, 614. In another embodiment, the perforations 610 can be parallel to one another and formed at an angle relative to the input and the output faces 613, 614. In another embodiment, the perforations 610 can be non-parallel to one another. In another embodiment, the perforations 610 can be non-parallel to one another and non-intersecting. In another embodiment, the perforations 610 can be intersecting. The perforated flame holder body 608 can be one piece or can be formed from a plurality of sections.

In another embodiment, which is not necessarily preferred, the perforated flame holder 612 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 612 may be formed from a ceramic material that has been punched, bored or cast to create channels.

In another embodiment, the perforated flame holder 612 can include a plurality of tubes or pipes bundled together. The plurality of perforations 610 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 608 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 608 can include discontinuous packing bodies such that the perforations 610 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g., Super Raschig Rings) that may be held together by a metal cage.

The inventors contemplate various explanations for why burner systems 600 including the perforated flame holder 612 provide such clean combustion.

According to an embodiment, the perforated flame holder 612 may act as a heat source to maintain the combustion reaction 702 even under conditions where the combustion reaction 702 would not be stable when supported by a conventional flame holder. This capability can be leveraged to support combustion using a leaner fuel-to-oxidant mixture than is typically feasible. Thus, according to an embodiment, at the point where the fuel stream 606 contacts the input face 613 of the perforated flame holder 612, an average fuel-to-oxidant ratio of the fuel stream 606 is below a (conventional) lower combustion limit of the fuel component of the fuel stream 606—lower combustion limit defines the lowest concentration of fuel at which a fuel and oxidant mixture 606 will burn when exposed to a momentary ignition source under normal atmospheric pressure and an ambient temperature of 25° C. (77° F.).

The perforated flame holder 612 and burner systems 600 including the perforated flame holder 612 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e., an equivalence ratio of ~0.87. Use of even leaner mixtures is possible, but may result in elevated levels of $O_2$. Moreover, the inventors believe the perforation walls 708 may act as a heat sink for the combustion fluid. This effect may alternatively or additionally reduce combustion temperatures and lower NOx.

According to another interpretation, production of NOx can be reduced if the combustion reaction 702 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 612 is very short compared to a conventional flame. The low NOx production associated with perforated flame holder combustion may thus be related to the short duration of time required for the reactants (and entrained nitrogen) to pass through the perforated flame holder 612.

Figure 8:
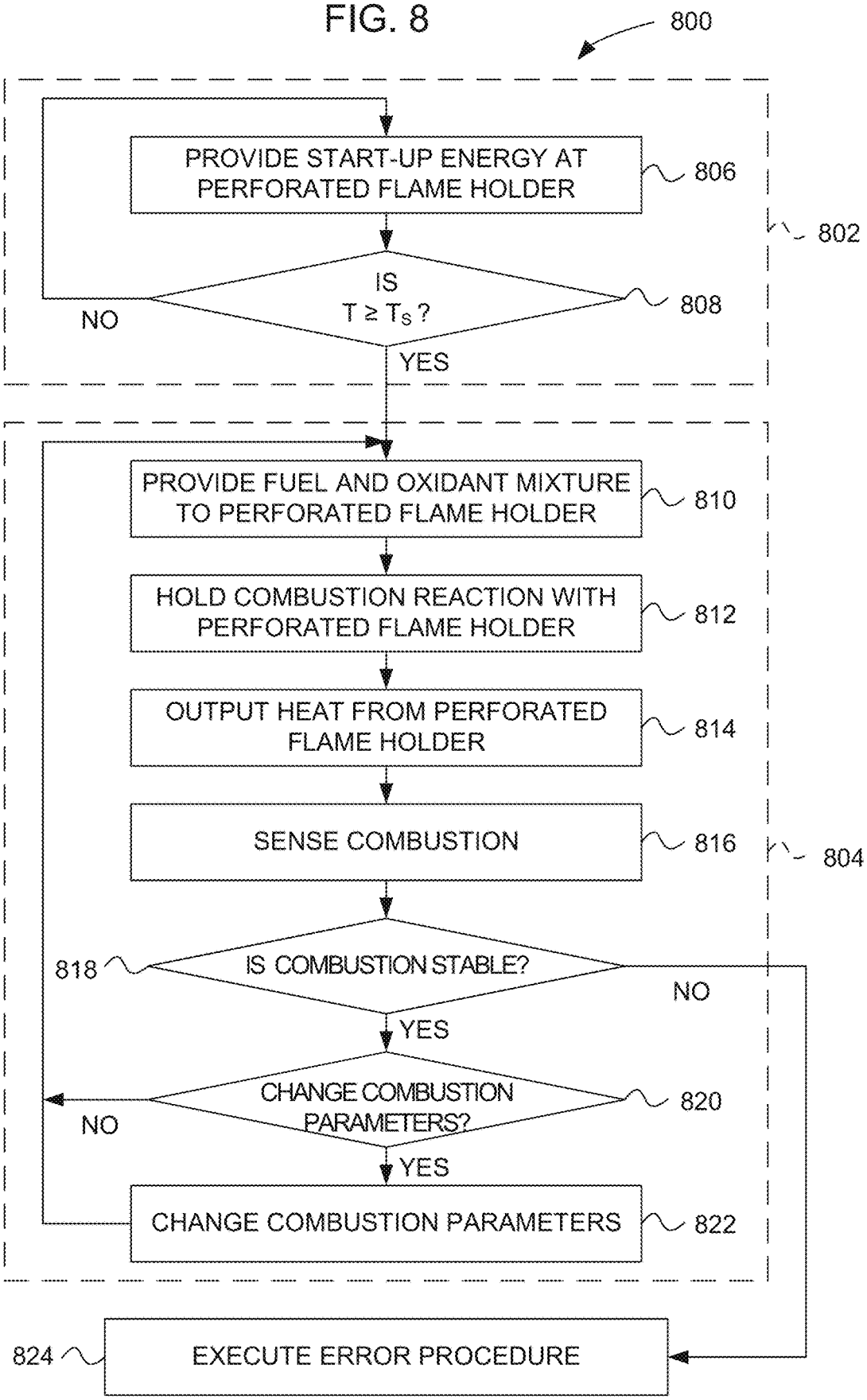
FIG. 8 is a flow chart showing a method for operating a burner system including the perforated flame holder shown and described herein, according to an embodiment.

FIG. 8 is a flow chart showing a method 800 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 800 begins with step 802, wherein the perforated flame holder is preheated to a start-up temperature, $T_S$. After the perforated flame holder is raised to the start-up temperature, the method proceeds to step 804, wherein the fuel and oxidant are provided to the perforated flame holder and combustion is held by the perforated flame holder.

According to a more detailed description, step 802 begins with step 806, wherein start-up energy is provided at the perforated flame holder. Simultaneously or following providing start-up energy, a decision step 808 determines whether the temperature T of the perforated flame holder is at or above the start-up temperature, $T_S$. As long as the temperature of the perforated flame holder is below its start-up temperature, the method loops between steps 806 and 808 within the preheat step 802. In decision step 808, if the temperature T of at least a predetermined portion of the perforated flame holder is greater than or equal to the start-up temperature, the method 800 proceeds to overall step 804, wherein fuel and oxidant is supplied to and combustion is held by the perforated flame holder.

Step 804 may be broken down into several discrete steps, at least some of which may occur simultaneously.

Proceeding from decision step 808, a fuel and oxidant mixture is provided to the perforated flame holder, as shown in step 810. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 812, the combustion reaction is held by the perforated flame holder.

In step 814, heat may be output from the perforated flame holder. The heat output from the perforated flame holder may be used to power an industrial process, heat a working fluid, generate electricity, or provide motive power, for example.

In optional step 816, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 816, a pilot flame or other ignition source may be provided to cause ignition of the fuel and oxidant mixture in the event combustion is lost at the perforated flame holder.

Proceeding to decision step 818, if combustion is sensed not to be stable, the method 800 may exit to step 824, wherein an error procedure is executed. For example, the error procedure may include turning off fuel flow, re-executing the preheating step 802, outputting an alarm signal, igniting a stand-by combustion system, or other steps. If, in decision step 818, combustion in the perforated flame holder is determined to be stable, the method 800 proceeds to decision step 820, wherein it is determined if combustion parameters should be changed. If no combustion parameters are to be changed, the method loops (within step 804) back to step 810, and the combustion process continues. If a change in combustion parameters is indicated, the method 800 proceeds to step 822, wherein the combustion parameter change is executed. After changing the combustion parameter(s), the method loops (within step 804) back to step 810, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 822. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 804.

Referring again to FIG. 6, the burner system 600 includes a heater 628 operatively coupled to the perforated flame holder 612. As described in conjunction with FIGS. 7 and 8, the perforated flame holder 612 operates by outputting heat to the incoming fuel and oxidant mixture 606. After combustion is established, this heat is provided by the combustion reaction 702; but before combustion is established, the heat is provided by the heater 628.

Various heating apparatuses have been used and are contemplated by the inventors. In some embodiments, the heater 628 can include a flame holder configured to support a flame disposed to heat the perforated flame holder 612. The fuel and oxidant source 102 can include the fuel nozzle 618 configured to emit the fuel stream 606 and the oxidant source 620 configured to output oxidant (e.g., combustion air) adjacent to the fuel stream 606. The fuel nozzle 618 and the oxidant source 620 can be configured to output the fuel stream 606 to be progressively diluted by the oxidant (e.g., combustion air). The perforated flame holder 612 can be disposed to receive a diluted fuel and oxidant mixture 606 that supports the combustion reaction 702 that is stabilized by the perforated flame holder 612 when the perforated flame holder 612 is at an operating temperature. A start-up flame holder, in contrast, can be configured to support a start-up flame at a location corresponding to a relatively unmixed fuel and oxidant mixture that is stable without stabilization provided by the heated perforated flame holder 612.

The burner system 600 can further include a controller 630 operatively coupled to the heater 628 and to a data interface 632. For example, the controller 630 can be configured to control a start-up flame holder actuator configured to cause the start-up flame holder to hold the start-up flame when the perforated flame holder 612 needs to be pre-heated and to not hold the start-up flame when the perforated flame holder 612 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 606 to cause heat-recycling and/or stabilizing vortices and thereby hold a start-up flame; or to be actuated to not intercept the fuel and oxidant mixture 606 to cause the fuel and oxidant mixture 606 to proceed to the perforated flame holder 612. In another embodiment, a fuel control valve, blower, and/or damper may be used to select a fuel and oxidant mixture 606 flow rate that is sufficiently low for a start-up flame to be jet-stabilized; and upon reaching a perforated flame holder 612 operating temperature, the flow rate may be increased to "blow out" the start-up flame. In another embodiment, the heater 628 may include an electrical power supply operatively coupled to the controller 630 and configured to apply an electrical charge or voltage to the fuel and oxidant mixture 606. An electrically conductive start-up flame holder may be selectively coupled to a voltage ground or other voltage selected to attract the electrical charge in the fuel and oxidant mixture 606. The attraction of the electrical charge was found by the inventors to cause a start-up flame to be held by the electrically conductive start-up flame holder.

In another embodiment, the heater 628 may include an electrical resistance heater configured to output heat to the perforated flame holder 612 and/or to the fuel and oxidant mixture 606. The electrical resistance heater 628 can be configured to heat up the perforated flame holder 612 to an operating temperature. The heater 628 can further include a power supply and a switch operable, under control of the controller 630, to selectively couple the power supply to the electrical resistance heater 628.

The electrical resistance heater 628 can be formed in various ways. For example, the electrical resistance heater 628 can be formed from KANTHAL® wire (available from Sandvik Materials Technology division of Sandvik AB of Hallstahammar, Sweden) threaded through at least a portion of the perforations 610 defined by the perforated flame holder body 608. Alternatively, the heater 628 can include an inductive heater, a high-energy beam heater (e.g., microwave or laser), a frictional heater, electro-resistive ceramic coatings, or other types of heating technologies.

Other forms of start-up apparatuses are contemplated. For example, the heater 628 can include an electrical discharge igniter or hot surface igniter configured to output a pulsed ignition to the oxidant and the fuel. Additionally or alternatively, a start-up apparatus can include a pilot flame apparatus disposed to ignite the fuel and oxidant mixture 606 that would otherwise enter the perforated flame holder 612. The electrical discharge igniter, hot surface igniter, and/or pilot flame apparatus can be operatively coupled to the controller 630, which can cause the electrical discharge igniter or pilot flame apparatus to maintain combustion of the fuel and oxidant mixture 606 in or upstream from the perforated flame holder 612 before the perforated flame holder 612 is heated sufficiently to maintain combustion.

The burner system 600 can further include a sensor 634 operatively coupled to the controller 630. The sensor 634 can include a heat sensor configured to detect infrared radiation or a temperature of the perforated flame holder 612. The control circuit 630 can be configured to control the heater 628 responsive to input from the sensor 634. Optionally, a fuel control valve 636 can be operatively coupled to the controller 630 and configured to control a flow of the fuel to the fuel and oxidant source 102. Additionally or alternatively, an oxidant blower or damper 638 can be operatively coupled to the controller 630 and configured to control flow of the oxidant (or combustion air).

The sensor 634 can further include a combustion sensor operatively coupled to the control circuit 630, the combustion sensor 634 being configured to detect a temperature, video image, and/or spectral characteristic of the combustion reaction 702 held by the perforated flame holder 612. The fuel control valve 636 can be configured to control a flow of the fuel from a fuel source to the fuel and oxidant source 102. The controller 630 can be configured to control the fuel control valve 636 responsive to input from the combustion sensor 634. The controller 630 can be configured to control the fuel control valve 636 and/or the oxidant blower or damper 638 to control a preheat flame type of heater 628 to heat the perforated flame holder 612 to an operating temperature. The controller 630 can similarly control the fuel control valve 636 and/or the oxidant blower or damper 638 to change the fuel and oxidant mixture 606 flow responsive to a heat demand change received as data via the data interface 632.

Figure 9A:
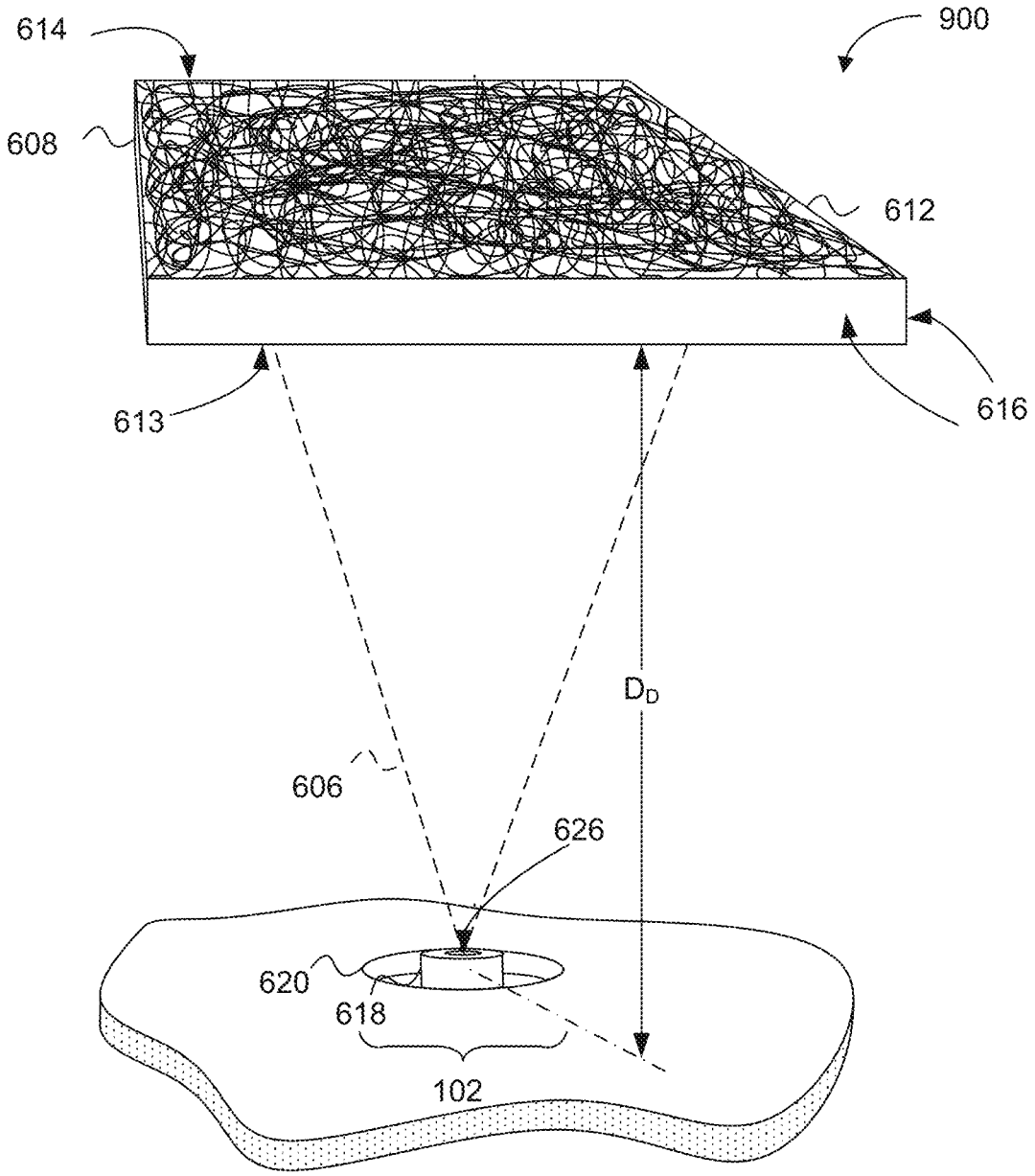
FIG. 9A is a simplified perspective view of a combustion system, including another alternative perforated flame holder, according to an embodiment.
Figure 9B:
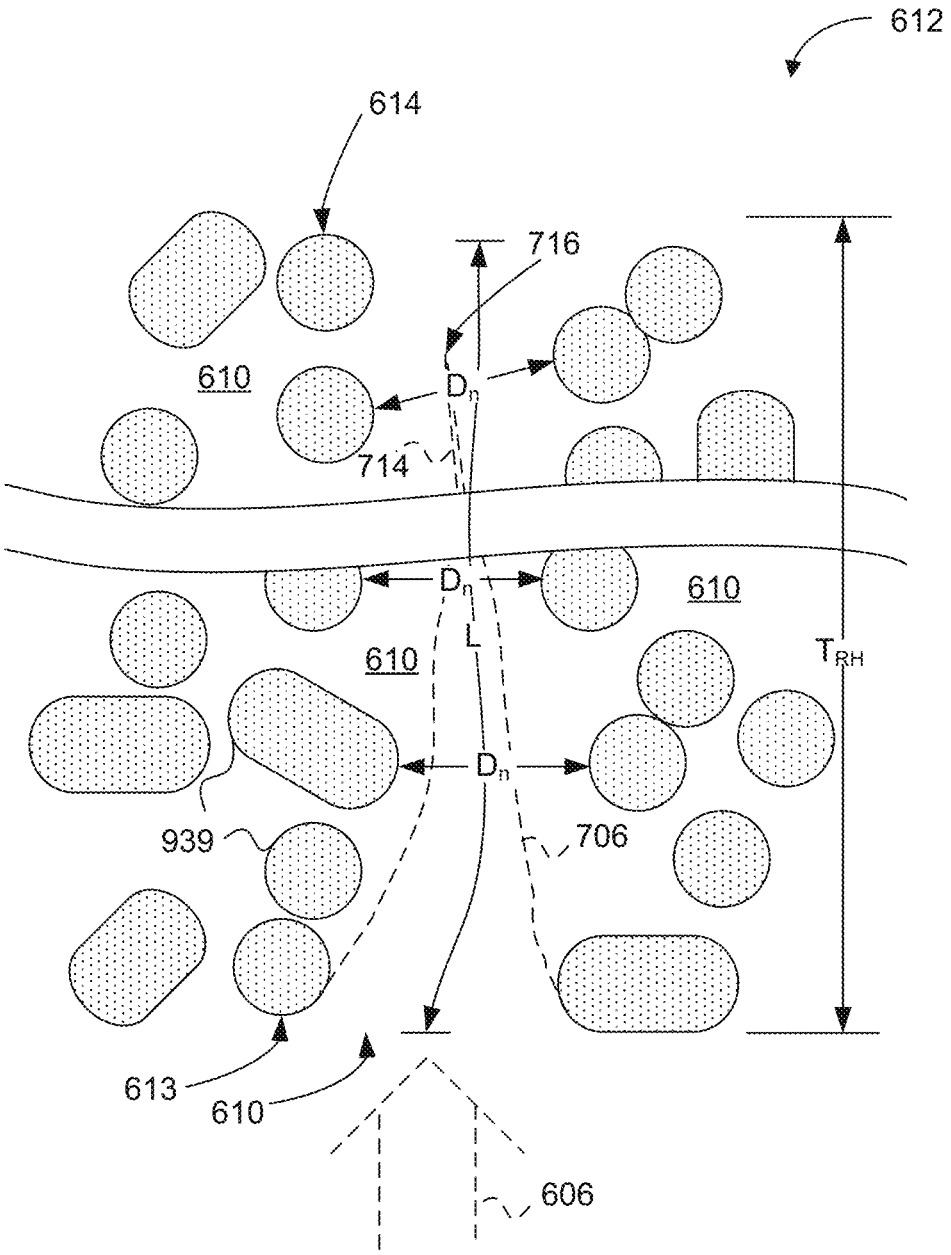
FIG. 9B is a simplified side sectional diagram of a portion of the reticulated ceramic perforated flame holder of FIG. 9A, according to an embodiment.

FIG. 9A is a simplified perspective view of a combustion system 900, including another alternative perforated flame holder 612, according to an embodiment. The perforated flame holder 612 is a reticulated ceramic perforated flame holder, according to an embodiment. FIG. 9B is a simplified side sectional diagram of a portion of the reticulated ceramic perforated flame holder 612 of FIG. 9A, according to an embodiment. The perforated flame holder 612 of FIGS. 9A, 9B can be implemented in the various combustion systems described herein, according to an embodiment. The perforated flame holder 612 is configured to support a combustion reaction (e.g., combustion reaction 702 of FIG. 7) of the fuel and oxidant mixture 606 received from the fuel and oxidant source 102 at least partially within the perforated flame holder 612. According to an embodiment, the perforated flame holder 612 can be configured to support a combustion reaction of the fuel and oxidant mixture 606 upstream, downstream, within, and adjacent to the reticulated ceramic perforated flame holder 612.

According to an embodiment, the perforated flame holder body 608 can include reticulated fibers 939. The reticulated fibers 939 can define branching perforations 610 that weave around and through the reticulated fibers 939. According to an embodiment, the perforations 610 are formed as passages between the reticulated fibers 939.

According to an embodiment, the reticulated fibers 939 are formed as a reticulated ceramic foam. According to an embodiment, the reticulated fibers 939 are formed using a reticulated polymer foam as a template. According to an embodiment, the reticulated fibers 939 can include alumina silicate. According to an embodiment, the reticulated fibers 939 can be formed from extruded mullite or cordierite. According to an embodiment, the reticulated fibers 939 can include Zirconia. According to an embodiment, the reticulated fibers 939 can include silicon carbide.

The term "reticulated fibers" refers to a netlike structure. According to an embodiment, the reticulated fibers 939 are formed from an extruded ceramic material. In reticulated fiber embodiments, the interaction between the fuel and oxidant mixture 606, the combustion reaction, and heat transfer to and from the perforated flame holder body 608 can function similarly to the embodiment shown and described above with respect to FIGS. 6-8. One difference in activity is a mixing between perforations 610, because the reticulated fibers 939 form a discontinuous perforated flame holder body 608 that allows flow back and forth between neighboring perforations 610.

According to an embodiment, the network of reticulated fibers 939 is sufficiently open for downstream reticulated fibers 939 to emit radiation for receipt by upstream reticulated fibers 939 for the purpose of heating the upstream reticulated fibers 939 sufficiently to maintain combustion of a fuel and oxidant mixture 606. Compared to a continuous perforated flame holder body 608, heat conduction paths (such as heat conduction paths 712 in FIG. 7) between the reticulated fibers 939 are reduced due to separation of the reticulated fibers 939. This may cause relatively more heat to be transferred from a heat-receiving region or area (such as heat receiving region 706 in FIG. 7) to a heat-output region or area (such as heat-output region 710 of FIG. 7) of the reticulated fibers 939 via thermal radiation (shown as element 704 in FIG. 7).

According to an embodiment, individual perforations 610 may extend between an input face 613 to an output face 614 of the perforated flame holder 612. The perforations 610 may have varying lengths L. According to an embodiment, because the perforations 610 branch into and out of each other, individual perforations 610 are not clearly defined by a length L.

According to an embodiment, the perforated flame holder 612 is configured to support or hold a combustion reaction (see element 702 of FIG. 7) or a flame at least partially between the input face 613 and the output face 614. According to an embodiment, the input face 613 corresponds to a surface of the perforated flame holder 612 proximal to the fuel nozzle 618 or to a surface that first receives fuel. According to an embodiment, the input face 613 corresponds to an extent of the reticulated fibers 939 proximal to the fuel nozzle 618. According to an embodiment, the output face 614 corresponds to a surface distal to the fuel nozzle 618 or opposite the input face 613. According to an embodiment, the input face 613 corresponds to an extent of the reticulated fibers 939 distal to the fuel nozzle 618 or opposite to the input face 613.

According to an embodiment, the formation of the thermal boundary layers 714, transfer of heat between the perforated flame holder body 608 and the gases flowing through the perforations 610, a characteristic perforation width dimension D, and the length L can each be regarded as related to an average or overall path through the perforated reaction holder 612. In other words, the dimension D can be determined as a root-mean-square of individual Dn values determined at each point along a flow path. Similarly, the length L can be a length that includes length contributed by tortuosity of the flow path, which may be somewhat longer than a straight line distance $T_{RH}$ from the input face 613 to the output face 614 through the perforated reaction holder 612. According to an embodiment, the void fraction (expressed as (total perforated reaction holder 612 volume—reticulated fiber 939 volume)/total volume)) is about 70%.

According to an embodiment, the reticulated ceramic perforated flame holder 612 is a tile about 1"×4"×4". According to an embodiment, the reticulated ceramic perforated flame holder 612 includes about 10 pores per square, meaning that a line laid across the surface of the reticulated ceramic perforated flame holder 612 will cross about 10 pores. This also results in about 100 pores per square inch of surface area. Other materials and dimensions can also be used for a reticulated ceramic perforated flame holder 612 in accordance with principles of the present disclosure.

According to an embodiment, the reticulated ceramic perforated flame holder 612 can include shapes and dimensions other than those described herein. For example, the perforated flame holder 612 can include reticulated ceramic tiles that are larger or smaller than the dimensions set forth above. Additionally, the reticulated ceramic perforated flame holder 612 can include shapes other than generally cuboid shapes.

According to an embodiment, the reticulated ceramic perforated flame holder 612 can include multiple reticulated ceramic tiles. The multiple reticulated ceramic tiles can be joined together such that each ceramic tile is in direct contact with one or more adjacent reticulated ceramic tiles. The multiple reticulated ceramic tiles can collectively form a single perforated flame holder 612. Alternatively, each reticulated ceramic tile can be considered a distinct perforated flame holder 612.

According to an embodiment, at least a portion of the one or more refractory bluff bodies 404 include one or more non-perforated flame holders 612.

Referring to FIGS. 5A and 5B, the frame 402 may include a latch 502 configured to compress the frame 402 against the inner wall or inner surface 206 of the combustion volume wall 104. The frame 402 may be held by force of gravity (weight), compression, and/or friction against the combustion volume wall 104. In one embodiment, the frame 402 is held in position by gravity (weight), position, compression, and/or friction against the inner wall or inner surface of a combustion pipe.

According to an embodiment, the latch 502 may include a moveable coupling 504 supported at a first end 506 of the frame 402, a bushing 507 coupled to the moveable coupling 504, a lever 508 rotatably engaged with the bushing 507, and a boss 510 supported at a second end 512 of the frame 402 and rotatably engaged with the lever 508. The geometry of the latch 502 may provide an over-center stable coupling of the ends 506, 512 of the frame 402 while in a compressed state. In an embodiment, the frame 402 is at least partly formed from high temperature steel. In another embodiment, the frame 402 is at least partly formed from stainless steel. Additionally and/or alternatively, the frame 402 is at least partly formed from a ceramic. In another embodiment, the frame 402 is at least partly formed from silicon carbide. In yet another embodiment, the frame 402 is at least partly formed from zirconium.

Figure 10:
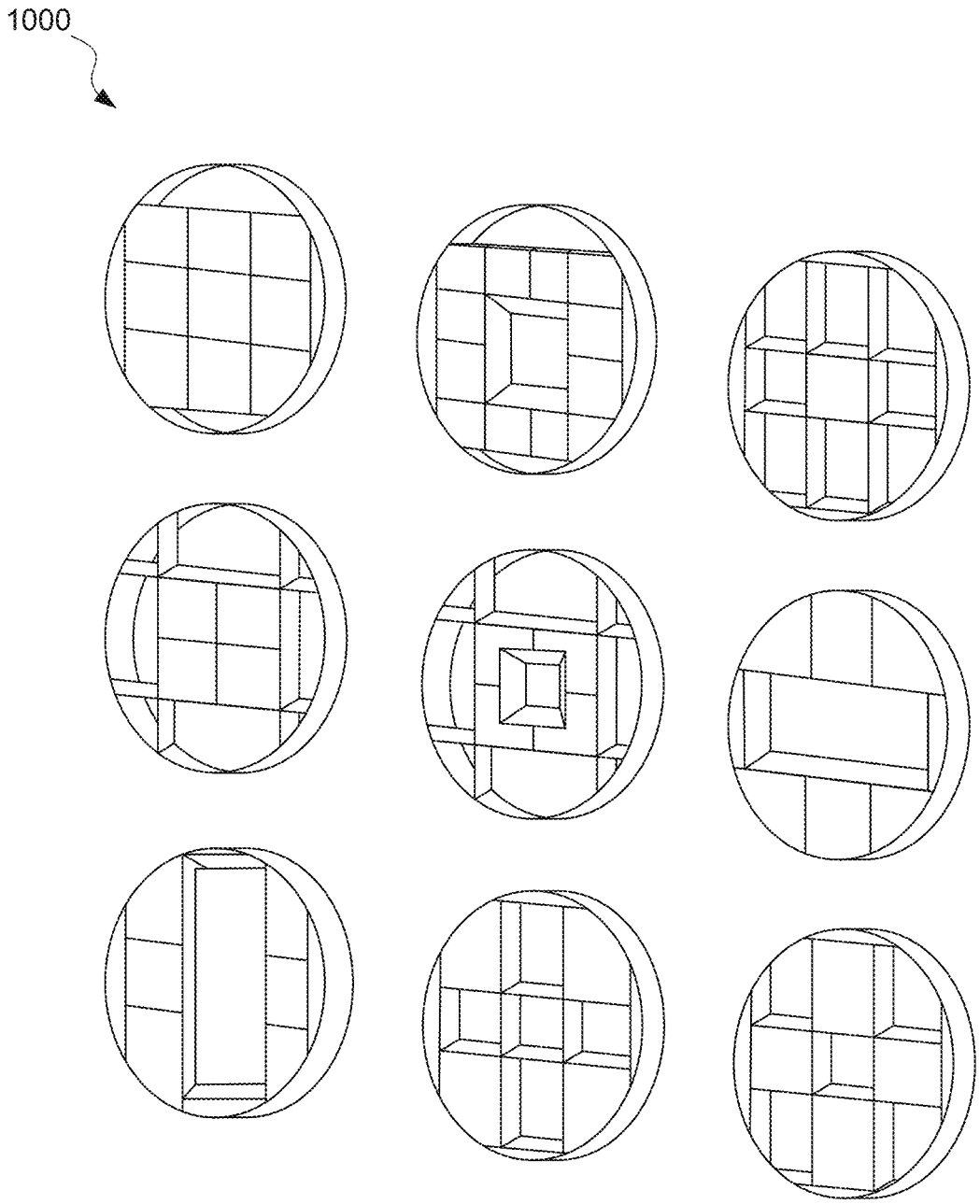
FIG. 10 illustrates several variants of bluff bodies supported alone and in combination, according to an embodiment.

FIG. 10 illustrates several variants 1000 of the bluff bodies 404 of FIG. 4 supported alone and in combination, according to an embodiment.

According to an embodiment, the combustion pipe 104 is characterized by a cross sectional area, and the frame 402 and the one or more refractory bluff bodies 404 subtend less than the entire cross sectional area. In one embodiment, the frame 402 and the one or more refractory bluff bodies 404 supported by the frame 402 include a single frame 402 supporting a plurality of bluff body tiles 404. In another embodiment, the frame 402 and the one or more refractory bluff bodies 404 supported by the frame 402 include a plurality of frames 402 supporting respective pluralities of bluff body tiles 404, each frame 402 being disposed at a different respective distance from the pilot burner of the fuel and combustion air source 102.

According to an embodiment, the fuel and combustion air source 102 including the secondary fuel source and configured to output the secondary fuel and combustion air into the combustion pipe 104. In an embodiment, the combustion volume wall 104 defines a lateral extent of the combustion volume 106 and is disposed to separate the combustion volume 106 from the water and steam volume 108. According to an embodiment, the combustion system further includes the mixing tube 110 aligned to receive the secondary fuel and combustion air from the fuel and combustion air source 102. The mixing tube 110 may be separated from the combustion volume wall 104 by the separation volume 116. The combustion volume wall 104 may include a combustion pipe 104 in a boiler. According to an embodiment, the refractory bluff bodies 404 are aligned to receive a secondary fuel and combustion air mixture from the outlet end 114 of the mixing tube 110. The refractory bluff bodies 404 may be configured to hold a combustion reaction for heating the combustion pipe 104. The combustion pipe 104 may be configured to heat the water in the water and steam volume 108.

Referring again to FIGS. 1, 2, and 3, according to an embodiment, the fuel and combustion air source 102 includes the fuel riser 332 extending to the tip 334, the primary combustion air plenum 306 including a wall disposed around the fuel riser 332, and defining the primary combustion air plenum chamber 304, and the variable swirler 302 disposed to controllably cause the primary combustion air to swirl at either of two or more different rotational velocities at at least a location corresponding to the tip 334 of the fuel riser 332.

According to an embodiment, the fuel and combustion air source 102 is operable to, in a first mode, support a pilot flame extending from an end of the primary combustion air plenum 306 proximal to the fuel riser tip 334, or, in a second mode, without supporting the pilot flame, supply combustion air to a bluff body flame holder 112.

According to an embodiment, a secondary fuel source includes one or more secondary fuel nozzles 346 disposed away from an output end 344 of the primary combustion air plenum 306.

According to an embodiment, the fuel and combustion air source 102 includes a secondary combustion air plenum 322 configured to output secondary combustion air 305 independently from an output of the primary combustion air 303.

According to an embodiment, the wall of the primary combustion air plenum 306 forms a tapered region at an outlet end of the primary combustion air plenum 306 near the tip 334 of the fuel riser 332.

Referring again to FIGS. 1, 2, and 3, a fuel and combustion air source 102 for a burner may include a fuel riser 332 extending to a tip 334, a wall of the primary combustion air plenum 306 disposed around the fuel riser 332 and defining a primary combustion air plenum chamber 304, and a variable swirler 302 disposed to controllably cause primary combustion air 303 to swirl at either of two or more different rotational velocities at at least a location corresponding to the tip 334 of the fuel riser 332. In one embodiment, the wall of the primary combustion air plenum 306 forms a tapered region 336 at an outlet end of the primary combustion air plenum 306 near the tip 334 of the fuel riser 332. The tapered region may include a varying diameter region 336 and a constant diameter region 338. In an embodiment, the fuel riser 332 provides a fuel orifice 310 at the tip 334. In another embodiment, the fuel riser 332 provides a fuel orifice 312 at a primary fuel output location disposed between a base 340 of the fuel riser 332 and the tip 334 of the fuel riser 332.

According to an embodiment, the fuel and air source for a burner may further include a lobe mixer 342 disposed proximate the tip 334 of the fuel riser 332. In one embodiment, the lobe mixer 342 is coupled to an end of the primary combustion air plenum 306.

According to an embodiment, the variable swirler 302 may include a plurality of actuatable fixed location blades that are collectively rotatable to at least two different angles. In another embodiment, the variable swirler 302 may include an air duct forming a tangential primary combustion air damper. In an embodiment, the variable swirler 302 is disposed within the wall of the primary combustion air plenum 306, radial to the fuel riser 332.

According to an embodiment, the fuel and air source for the burner is operable to, in a first mode, support a pilot flame extending from an end 344 of an end of the primary combustion air plenum 306 proximal to the fuel riser tip 334, or, in a second mode, without supporting the pilot flame, supply combustion air to a bluff body flame holder 112.

According to an embodiment, the fuel and air source 102 for the burner further may include the one or more secondary fuel nozzles 346 disposed away from the output end 344 of the primary combustion air plenum 306.

According to an embodiment, the fuel and air source 102 for the burner further may include the secondary combustion air plenum 322 configured to output secondary combustion air independently from an output of the primary combustion air 303.

According to an embodiment, the fuel and air source 102 for the burner further may include the bell mouth 204 disposed to receive the air and the fuel from the air and fuel source 102 and an educed flue gas flow, and the mixing tube 110 operatively coupled to the bell mouth 204. The mixing tube 110 may be operable to intermittently mix the air and the fuel, and receive heat from the intermittently supported flame. The fuel and air source 102 for the burner may include a flame holder disposed to intermittently receive heat from the flame and receive the fuel and air flow, and to respectively increase in temperature and hold a second flame. In an embodiment, the flame holder is a bluff body flame holder 112. In one embodiment, the bluff body flame holder 112 may include one or more bluff bodies. In another embodiment, the bluff body flame holder 112 may be configured to output heat and convention with the second flame. The combustion volume wall 104 may include a combustion pipe 104. The combustion pipe 104 may be configured to heat water in a water and steam volume 108. In another embodiment, the bluff body flame holder 112 may include a frame 402 configured to be held in the combustion volume 106 by gravity. Additionally or alternatively, the bluff body flame holder 112 may include one or more refractory bluff bodies 404 supported by the frame 402.

According to an embodiment, the output end 344 of the primary combustion air plenum 306 is configured to hold a flame at high air and fuel mixture rotational velocity and allow the air and the fuel to pass without holding the flame at low air and fuel mixture rotational velocity.

Figure 11:
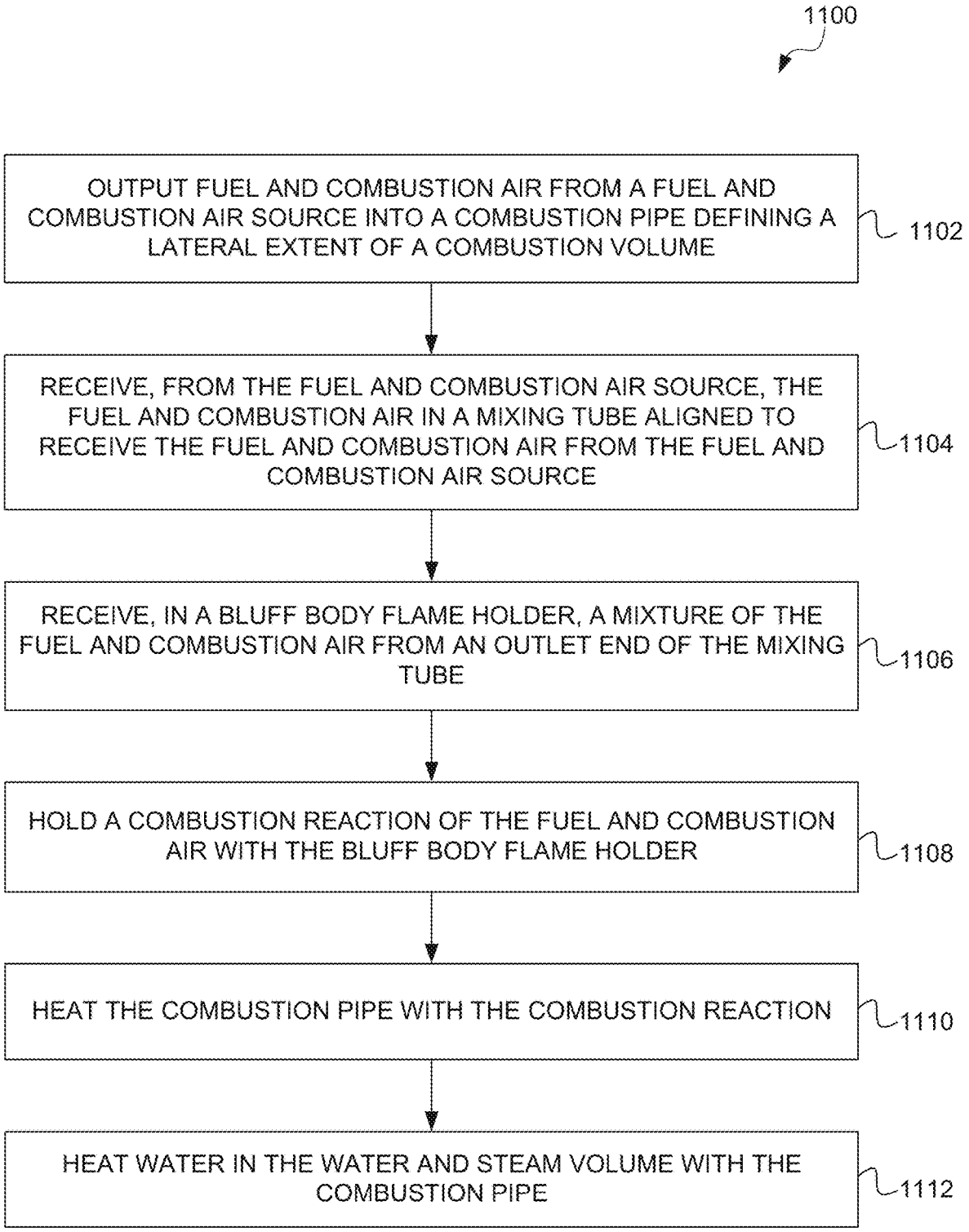
FIG. 11 is a flow chart showing a method of operating a boiler heater, according to an embodiment.

FIG. 11 is a flow chart showing a method 1100 of operating a fired heater, according to an embodiment.

According to an embodiment, the method 1100 of operating a fired heater includes, in step 1102, outputting fuel and combustion air from a fuel and combustion air source into a combustion pipe defining a lateral extent of a combustion volume. The combustion pipe may be disposed to separate the combustion volume from a water and steam volume. Step 1104 includes receiving, from the fuel and combustion air source, the fuel and combustion air in a mixing tube aligned to receive the fuel and combustion air from the fuel and combustion air source. The mixing tube may be separated from the combustion pipe by a separation volume. Step 1106 includes receiving, in a bluff body flame holder, a mixture of the fuel and combustion air from an outlet end of the mixing tube. Step 1108 incudes holding a combustion reaction of the fuel and combustion air with the bluff body flame holder. Step 1110 includes heating the combustion pipe with the combustion reaction, and step 1112 includes heating water in the water and steam volume with the combustion pipe.

Figure 12:
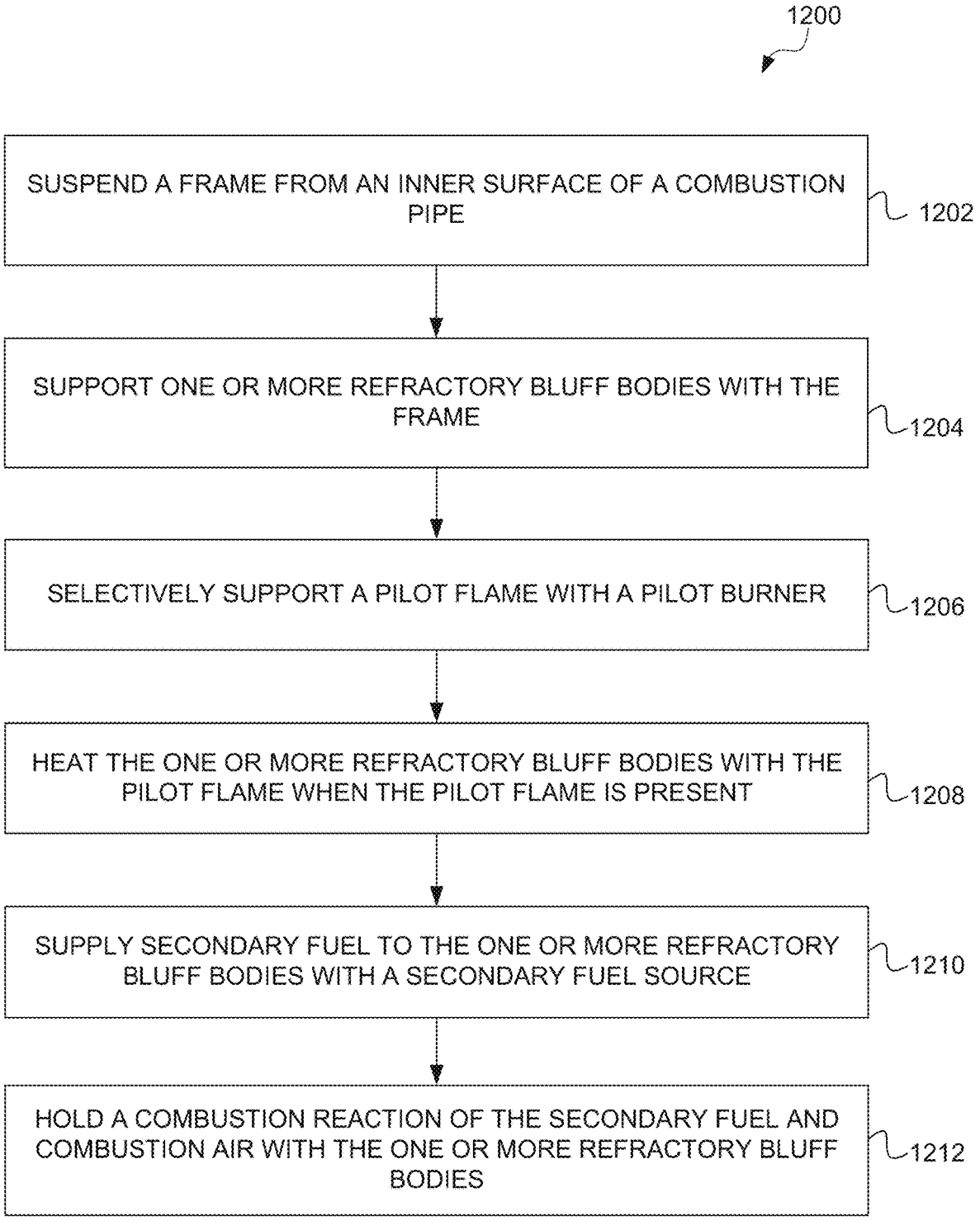
FIG. 12 is a flow chart showing a method of operating a combustion system, according to an embodiment.

FIG. 12 is a flow chart showing a method 1200 of operating a combustion system, according to an embodiment.

According to an embodiment, the method 1200 includes, in step 1202, suspending a frame from an inner surface of a combustion pipe. Step 1204 includes supporting one or more refractory bluff bodies with the frame. Step 1206 includes selectively supporting a pilot flame with a pilot burner. Step 1208 includes heating the one or more refractory bluff bodies with the pilot flame when the pilot flame is present. Step 1210 includes supplying secondary fuel to the one or more refractory bluff bodies with a secondary fuel source, and step 1212 includes holding a combustion reaction of the secondary fuel and combustion air with the one or more refractory bluff bodies.

Figure 13:
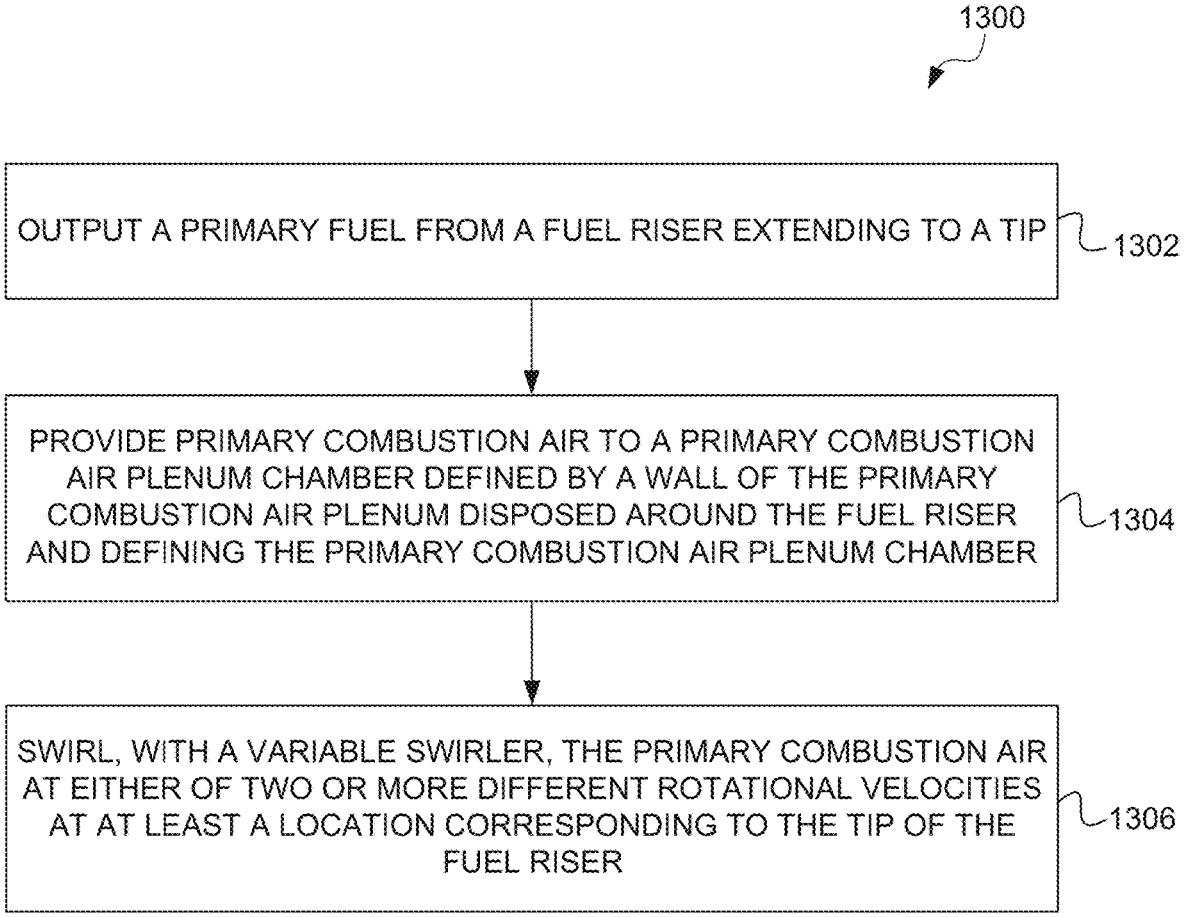
FIG. 13 is a flow chart showing a method of operating a fuel and air source for a burner, according to an embodiment.

FIG. 13 is a flow chart showing a method 1300 of operating a fuel and air source for a burner, according to an embodiment.

According to an embodiment, the method 1300 of operating a fuel and air source for a burner includes, in step 1302, outputting a primary fuel from a fuel riser extending to a tip. Step 1304 includes providing primary combustion air to a primary combustion air plenum chamber defined by a wall of the primary combustion air plenum disposed around the fuel riser and defining the primary combustion air plenum chamber. Step 1306 includes swirling, with a variable swirler, the primary combustion air at either of two or more different rotational velocities at at least a location corresponding to the tip of the fuel riser. In an embodiment, in step 1304, the wall of the primary combustion air plenum forms a tapered region at an outlet end of the primary combustion air plenum near the tip of the fuel riser.

In one embodiment, a frame is configured to hold a flame holder, according to an embodiment. The frame can include a hexagonal shape with, in one example, three or more sets of rails coupled to an interior surface of the frame. Each set of rails includes one rail on a first plane of the interior surface of the hexagon and a second rail on a second plane directly opposing the first plane. Each set of rails can hold a bluff body tile. Accordingly, the flame holder can be a bluff body flame holder.

According to an embodiment, the bluff body flame holder includes one or more solid refractory bodies disposed at a distance separated from the mixing tube to receive the mixed fuel, air, and flue gas.

According to an embodiment, the one or more refractory bluff bodies comprise substantially combustion air-impervious solid ceramic tiles configured to prevent combustion from occurring within the ceramic tiles.

In an embodiment, the one or more refractory bluff bodies are disposed to provide vortex-recirculated heat and vortex-recirculated mass flow of combustion fluids to maintain the combustion reaction in one or more regions upstream from, downstream from, and/or around the one or more refractory bluff bodies. Additionally or alternatively, the one or more refractory bluff bodies comprise a plurality of refractory bluff bodies configured to maintain the combustion reaction between the plurality of refractory bluff bodies.

In one embodiment, the bluff body flame holder includes zirconia. In another embodiment, the bluff body flame holder includes alumina silicate. Additionally or alternatively, the bluff body flame holder includes silicon carbide. In one embodiment, the bluff body includes mullite. In another embodiment, the bluff body includes cordierite.

According to an embodiment, the one or more refractory bluff bodies include a plurality of refractory tiles having a thickness, a width, and a length, the thickness being no more than 40% of the lesser of the width and the length. The plurality of refractory tiles may be disposed to present a thickness perpendicular to fluid flow and wherein a width× length plane lies parallel to fluid flow.

In an embodiment, the plurality of refractory tiles have a thickness no more than 30% of the lesser of the width and the length. The plurality of refractory tiles may have a thickness being no more than 20% of the lesser of the width and the length.

According to an embodiment, at least one of the plurality of refractory tiles is a perforated refractory tile capable of supporting combustion within the tile perforations. The inventors found that presenting a narrow thickness plane or combination of thickness planes (e.g., two planes, each at a 45 degree angle to flow) toward the fluid flow may provide higher firing capacity than other orientations.

According to an embodiment, at least one of the plurality of refractory tiles is a solid refractory tile capable of excluding combustion from occurring within the tile. According to an embodiment, at least one of the refractory tiles is a perforated tile. The perforated tile can include a reticulated ceramic perforated tile. The frame can hold a combination of solid refractory tiles and perforated ceramic tiles. The inventors anticipate that a combination of solid tiles and perforated tiles may provide desirable performance characteristics. A different number of tiles may similarly display desirable performance characteristics. For example, the inventors, in one embodiment, omitted the center tile and kept the other two tiles shown While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A fired heater, comprising:

a fuel and combustion air source configured to output fuel and combustion air into a combustion volume, the combustion volume including a combustion volume wall defining a lateral extent separate from an exterior volume;

a mixing tube aligned to receive the fuel and the combustion air from the fuel and combustion air source, the mixing tube being separated from the combustion volume wall by a separation volume; and a bluff body flame holder aligned to receive a fuel and combustion air mixture from an outlet end of the mixing tube, the bluff body flame holder being configured to hold a combustion reaction for heating the combustion volume wall, wherein the combustion volume wall is configured to heat a volume thermal load, wherein the mixing tube includes an outlet end disposed proximate to and spaced a non-zero distance from the bluff body flame holder.

2. The fired heater of claim 1, wherein the fired heater comprises a boiler heater; and wherein the combustion volume wall comprises a combustion pipe defining a lateral extent of the combustion volume, the combustion pipe being disposed to separate the combustion volume from a water and steam volume.

3. The boiler heater of claim 2, wherein the combustion pipe is configured to be kept cool by the water in the water and steam volume; and wherein the mixing tube is configured to be kept warm by the combustion reaction and flue gas;

whereby a cool temperature of the combustion pipe is configured to draw the flue gas produced by the combustion reaction from a region near the bluff body flame holder toward an inlet end of the mixing tube; and wherein the flue gas is educed into the mixing tube by a flow of the fuel and the combustion air output by the fuel and combustion air source.

4. The fired heater of claim 1, wherein the separation volume includes an annular volume between the mixing tube and the combustion volume wall; and wherein the mixing tube further includes an inlet end separated from the fuel and combustion air source.

5. The fired heater of claim 4, wherein the mixing tube further includes a cylindrical portion, and wherein the inlet end of the mixing tube includes a bell mouth that tapers toward the cylindrical portion of the mixing tube and away from the fuel and combustion air source.

6. The fired heater of claim 5, wherein the bell mouth is separated from the fuel and combustion air source to educe flue gas that passes through the annular volume from the outlet end of the mixing tube toward the inlet end of the mixing tube.

7. The fired heater of claim 1, wherein the fuel and combustion air source is configured to selectively hold a pilot flame; and wherein the fuel and combustion air source includes a controllable swirler configured to selectively apply a swirling motion to primary combustion air that flows within a primary combustion air plenum.

8. The fired heater of claim 7, wherein the fuel and combustion air source is configured to selectively hold the pilot flame when the controllable swirler selectively applies the swirling motion to the primary combustion air.

9. The fired heater of claim 1, wherein the fuel and combustion air source includes a first combustion air damper configured to control a flow of the primary combustion air through a primary combustion air plenum; and wherein the fuel and combustion air source includes a second combustion air damper configured to control secondary combustion air through a secondary combustion air plenum.

10. The fired heater of claim 1, wherein the bluff body flame holder includes one or more perforated flame holders.

11. The fired heater of claim 10, wherein the one or more perforated flame holders include a reticulated ceramic perforated flame holder.

12. The fired heater of claim 1, further comprising a frame configured to be suspended from an inner surface of the combustion volume wall;

wherein the frame is configured to support the bluff body flame holder within the combustion volume wall;

wherein the bluff body flame holder includes two or more bluff bodies; and wherein the frame and the two or more bluff bodies supported by the frame include a plurality of frames supporting respective pluralities of bluff body tiles, each frame being disposed at a different respective distance from the fuel and combustion air source.

13. The fired heater of claim 12, wherein the frame and the two or more refractory bluff bodies supported by the frame include a plurality of frames supporting the respective pluralities of bluff body tiles, each frame being disposed at a different respective distance from a pilot burner of the fuel and combustion air source.

14. The fired heater of claim 1, wherein the bluff body flame holder comprises:

one or more solid refractory bodies disposed at a distance separated from the outlet end of the mixing tube to receive the mixed fuel, the combustion air, and flue gas.

15. A fired heater, comprising:

a fuel and combustion air source configured to output fuel and combustion air into a combustion volume, the combustion volume including a combustion volume wall defining a lateral extent separate from an exterior volume;

a mixing tube aligned to receive the fuel and the combustion air from the fuel and combustion air source, the mixing tube being separated from the combustion volume wall by a separation volume; and a bluff body flame holder aligned to receive a fuel and combustion air mixture from an outlet end of the mixing tube, the bluff body flame holder being configured to hold a combustion reaction for heating the combustion volume wall, wherein the combustion volume wall is configured to heat a volume thermal load, wherein the fuel and combustion air source includes:

a primary combustion air plenum;

a first fuel circuit disposed and configured to selectively output primary fuel to one or more locations within the primary combustion air plenum; and a second fuel circuit disposed and configured to selectively output secondary fuel through a plurality of fuel risers disposed outside the primary combustion air plenum.

16. The fired heater of claim 15, wherein the fuel and combustion air source is configured to supply the fuel and the combustion air to the bluff body flame holder when the first fuel circuit is stopped and when the second fuel circuit is opened; and wherein the fuel and combustion air source is configured to support a pilot flame when the first fuel circuit is opened and when the second fuel circuit is closed.

17. A fired heater, comprising:

a fuel and combustion air source configured to output fuel and combustion air into a combustion volume, the combustion volume including a combustion volume wall defining a lateral extent separate from an exterior volume;

a mixing tube aligned to receive the fuel and the combustion air from the fuel and combustion air source, the mixing tube being separated from the combustion volume wall by a separation volume; and a bluff body flame holder aligned to receive a fuel and combustion air mixture from an outlet end of the mixing tube, the bluff body flame holder being configured to hold a combustion reaction for heating the combustion volume wall, wherein the combustion volume wall is configured to heat a volume thermal load, wherein the fuel and combustion air source includes:

a fuel riser extending to a tip;

a primary combustion air plenum including a plenum wall disposed around the fuel riser and defining a primary combustion air plenum chamber; and a variable swirler disposed to controllably cause the primary combustion air to swirl at either of two or more different rotational velocities at at least a location corresponding to the tip of the fuel riser.

18. The fired heater of claim 17, wherein the plenum wall of the primary combustion air plenum forms a tapered region at an outlet end of the primary combustion air plenum near the tip of the fuel riser.

19. A fired heater, comprising:

a fuel and combustion air source configured to output fuel and combustion air into a combustion volume, the combustion volume including a combustion volume wall defining a lateral extent separate from an exterior volume;

a mixing tube aligned to receive the fuel and the combustion air from the fuel and combustion air source, the mixing tube being separated from the combustion volume wall by a separation volume; and a bluff body flame holder aligned to receive a fuel and combustion air mixture from an outlet end of the mixing tube, the bluff body flame holder being configured to hold a combustion reaction for heating the combustion volume wall, wherein the combustion volume wall is configured to heat a volume thermal load, wherein the fuel and combustion air source includes a lobe mixer disposed to increase radial mixing of the fuel, the combustion air, and flue gas recirculated from the combustion reaction.

* * * * *